US010604873B2

(12) United States Patent
Diaz et al.

(10) Patent No.: US 10,604,873 B2
(45) Date of Patent: Mar. 31, 2020

(54) UPPER-TORSO GARMENT WITH TUBULAR-JACQUARD KNIT STRUCTURE

(71) Applicant: NIKE, Inc., Beaverton, OR (US)

(72) Inventors: Josue Diaz, Portland, OR (US); Virginia Meckley, Hillsboro, OR (US); Paul R. Montgomery, Portland, OR (US); Nicole Rendone, Beaverton, OR (US); Andrea J. Staub, Portland, OR (US)

(73) Assignee: NIKE, INC., Beaverton, OR (US)

( * ) Notice: Subject to any disclaimer, the term of this patent is extended or adjusted under 35 U.S.C. 154(b) by 0 days.

(21) Appl. No.: 16/166,378

(22) Filed: Oct. 22, 2018

(65) Prior Publication Data

US 2019/0055683 A1 Feb. 21, 2019

Related U.S. Application Data

(63) Continuation of application No. 15/584,925, filed on May 2, 2017, now Pat. No. 10,145,042.

(51) Int. Cl.

| | |
|---|---|
| ***D04B 1/24*** | (2006.01) |
| ***A41C 3/00*** | (2006.01) |
| ***D04B 1/10*** | (2006.01) |

(52) U.S. Cl.

CPC ..... *D04B 1/246* (2013.01); *A41C 3/0014* (2013.01); *A41C 3/0057* (2013.01); *D04B 1/108* (2013.01); *A41B 2500/10* (2013.01); *D10B 2403/023* (2013.01); *D10B 2403/0211* (2013.01); *D10B 2403/0212* (2013.01); *D10B 2403/0221* (2013.01); *D10B 2403/0222* (2013.01); *D10B 2501/061* (2013.01)

(58) Field of Classification Search

CPC ..... D04B 1/246; D04B 1/102; D04B 7/28; D04B 9/08; D04B 1/18; A41C 3/0014; A41C 3/005; A41C 3/0057; A41C 3/0085; A41C 3/0021

See application file for complete search history.

(56) References Cited

U.S. PATENT DOCUMENTS

| | | | |
|---|---|---|---|
| 1,984,326 | A | 12/1934 | Titone |
| 2,397,247 | A | 3/1946 | Davidson |
| 2,707,381 | A | 5/1955 | Lombardi |

(Continued)

FOREIGN PATENT DOCUMENTS

| | | | |
|---|---|---|---|
| DE | 2036542 | A1 | 2/1972 |
| EP | 0261800 | A2 | 3/1988 |

(Continued)

OTHER PUBLICATIONS

Zheng, Rong, Winnie Yu, and Jintu Fan, "Pressure evaluation of 3D seamless knitted bras and conventional wired bras," Fibers and Polymers 10.1 (2009): 124-131. http://www.researchgate.net/profile/Winnie_Yu/publication/225481465_Pressure_evaluation_of_3D_seamless_knitted_bras_and_conventional_wired_bras/links/54d029160cf24601c0964062.pdf.

(Continued)

*Primary Examiner* — Danny Worrell

(74) *Attorney, Agent, or Firm* — Shook, Hardy & Bacon, LLP

(57) ABSTRACT

An upper-torso garment includes a first knit zone and a second knit zone. The first knit zone includes a first tubular-jacquard knit structure and having a first modulus of elasticity, and the second knit zone includes a second tubular-jacquard knit structure and having a second modulus of elasticity, which is greater than the first modulus of elasticity.

20 Claims, 16 Drawing Sheets

(56) References Cited

U.S. PATENT DOCUMENTS

| | | | |
|---|---|---|---|
| 2,899,812 | A | 8/1959 | Attenborough |
| 2,946,211 | A | 7/1960 | Morancy |
| 3,092,987 | A | 6/1963 | Levine |
| 3,167,938 | A | 2/1965 | Seiler |
| 3,241,340 | A | 3/1966 | Knohl |
| 3,389,580 | A | 6/1968 | Bentley et al. |
| 3,500,665 | A | 3/1970 | Braxton et al. |
| 3,537,279 | A | 11/1970 | Epley |
| 3,561,234 | A | 2/1971 | Mishcon et al. |
| 3,640,096 | A | 2/1972 | Betts et al. |
| 3,668,896 | A | 6/1972 | Betts et al. |
| 3,668,898 | A | 6/1972 | Betts et al. |
| 3,677,252 | A | 7/1972 | Pedley |
| 3,695,063 | A | 10/1972 | Betts et al. |
| 3,789,098 | A | 1/1974 | Cole et al. |
| 3,796,068 | A | 3/1974 | Betts et al. |
| 3,985,003 | A | 10/1976 | Reed |
| 4,019,350 | A | 4/1977 | Schmidt |
| 4,100,766 | A | 7/1978 | Kuhnert |
| 4,267,710 | A | 5/1981 | Imamichi |
| 4,311,150 | A | 1/1982 | Schreiber et al. |
| 4,356,710 | A | 11/1982 | Mizuno et al. |
| 4,419,997 | A | 12/1983 | Cole et al. |
| 5,120,264 | A | 6/1992 | Van Engel |
| 5,214,941 | A | 6/1993 | Essig |
| 5,359,865 | A | 11/1994 | So |
| 5,787,503 | A | 8/1998 | Murphy, III |
| 5,887,451 | A | 3/1999 | Suzuki |
| 5,890,381 | A | 4/1999 | Leeke et al. |
| 5,916,272 | A | 6/1999 | Nonnenmacher et al. |
| 5,946,944 | A | 9/1999 | Osborne |
| 5,956,765 | A | 9/1999 | Chin |
| 6,089,052 | A | 7/2000 | Riegger |
| 6,178,784 | B1 | 1/2001 | Marley |
| 6,443,805 | B1 | 9/2002 | Kirkwood |
| 6,526,783 | B2 | 3/2003 | Sheu |
| 6,550,286 | B2 | 4/2003 | Querquant |
| 6,645,040 | B2 | 11/2003 | Rabinowicz et al. |
| 6,685,534 | B2 | 2/2004 | Mitchell et al. |
| 6,779,367 | B2 | 8/2004 | Mitchell et al. |
| 6,779,369 | B2 | 8/2004 | Shepherd |
| 6,824,445 | B2 | 11/2004 | Oneyear et al. |
| 6,899,591 | B2 | 5/2005 | Mitchell |
| RE38,853 | E | 10/2005 | Rabinowicz |
| 7,001,240 | B1 | 2/2006 | Huffman-Jimenez |
| 7,043,329 | B2 | 5/2006 | Dias et al. |
| 7,169,011 | B2 | 1/2007 | Mitchell et al. |
| 7,442,110 | B2 | 10/2008 | Gaudet et al. |
| 7,536,879 | B2 | 5/2009 | Vanwelden |
| 7,611,999 | B2 | 11/2009 | McMurray |
| 7,614,256 | B2 | 11/2009 | Mitchell |
| 7,716,954 | B2 | 5/2010 | Naka et al. |
| 8,128,457 | B2 | 3/2012 | Reinisch et al. |
| 8,226,452 | B2 | 7/2012 | Hendrickson |
| 8,398,453 | B2 | 3/2013 | Mitchell et al. |
| 8,469,769 | B2 | 6/2013 | Hendrickson |
| 8,550,872 | B2 | 10/2013 | Upton et al. |
| 8,640,503 | B2 | 2/2014 | Kunde et al. |
| 8,690,634 | B2 | 4/2014 | Heath et al. |
| 9,375,045 | B2 | 6/2016 | Farris et al. |
| 9,375,046 | B2 | 6/2016 | Meir |
| 9,405,205 | B2 | 8/2016 | De Graaf et al. |
| 9,538,794 | B2 | 1/2017 | Turlan |
| 10,145,042 | B2 | 12/2018 | Diaz et al. |
| 10,179,960 | B2 | 1/2019 | Diaz et al. |
| 2004/0097151 | A1 | 5/2004 | McMurray |
| 2004/0099016 | A1 | 5/2004 | Shepherd |
| 2004/0168479 | A1 | 9/2004 | McMurray |
| 2005/0115282 | A1 | 6/2005 | Starbuck |
| 2005/0255789 | A1 | 11/2005 | Gaudet et al. |
| 2006/0243000 | A1 | 11/2006 | Turlan et al. |
| 2008/0268217 | A1 | 10/2008 | Kanatani et al. |
| 2010/0184355 | A1 | 7/2010 | Kennedy |
| 2014/0068968 | A1 | 3/2014 | Podhajny et al. |
| 2014/0366585 | A1 | 12/2014 | Shen et al. |
| 2016/0251782 | A1 | 9/2016 | Liao et al. |
| 2017/0119063 | A1 | 5/2017 | Diaz et al. |
| 2018/0317568 | A1 | 11/2018 | Diaz et al. |

FOREIGN PATENT DOCUMENTS

| | | | |
|---|---|---|---|
| EP | 1449946 | A1 | 8/2004 |
| EP | 2952616 | A1 | 12/2015 |
| GB | 1574736 | A | 9/1980 |
| JP | 5361320 | A | 12/2013 |
| WO | 2005041702 | A2 | 5/2005 |
| WO | 2011106014 | A1 | 9/2011 |
| WO | 2016197051 | A1 | 12/2016 |
| WO | 2018203895 | A1 | 11/2018 |

OTHER PUBLICATIONS

"Leading Lady Seamless Knit Nursing Bra," Hanes®, hanes.com, Style #24304, accessed Oct. 12, 2015 http://www.hanes.com/hanes/onehanesplace/bra/shop-by-category/nursing-bras/leading-lady-nursing-bra-24304.

Simplicity Mother's Breast Feeding Maternity Nursing Bra Tank Top Camisole, Amazon, amazon.com, Accessed Oct. 2015 http://www.amazon.com/Simplicity%C2%AE-Womens-Maternity-Nursing-Sleeveless/dp/B00LQ1O8FK.

Stoll Performance Plus SS-2016-ES Brochure, © 2016 H. Stoll AG & Co., KG, Germany, 36 pages.

"Breast sizing and development of 3D seamless bra"; Rong Zheng; 2007 http://ira.lib.polyu.edu.hk/handle/10397/2619.

"Three Dimensional Seamless Garment Knitting on VBedFlat Knitting Machines"; Wonseok Choi et al. https://www.researchgate.net/publication/237482349_Three_dimensional_seamless_garment_knitting_on_V-bed_flat_knitting_machines.

Non-Final Office Action dated Feb. 7, 2019 in U.S. Appl. No. 15/584,950, 8 pages.

Notice of Allowance dated Mar. 21, 2019 in U.S. Appl. No. 15/341,788, 17 pages.

Notice of Allowance dated Jun. 3, 2019 in U.S. Appl. No. 15/584,950, 5 pages.

Non-Final Office Action dated Jul. 25, 2019 in U.S. Appl. No. 15/584,938, 9 pages.

International Preliminary Report on Patentability dated Nov. 14, 2019 in International Patent Application No. PCT/US2017/030859, 9 pages.

International Preliminary Report on Patentability dated Nov. 14, 2019 in International Patent Application No. PCT/US2017/030947, 9 pages.

International Preliminary Report on Patentability dated Nov. 14, 2019 in International Patent Application No. PCT/US2017/030863, 8 pages.

International Preliminary Report on Patentability dated Nov. 14, 2019 in International Patent Application No. PCT/US2017/030861, 9 pages.

International Search Report and Written Opinion dated Dec. 16, 2019 in International Patent Application No. PCT/US2019/052592, 14 pages.

UPPER-TORSO GARMENT WITH TUBULAR-JACQUARD KNIT STRUCTURE

CROSS-REFERENCE TO RELATED APPLICATIONS

This application entitled "Upper-Torso Garment with Tubular Jacquard Knit Structure," is a Continuation Application of co-pending U.S. application Ser. No. 15/584,925, entitled "Upper-Torso Garment with Tubular-Jacquard Knit Structure," and filed May 2, 2017. The entirety of the aforementioned application is incorporated by reference herein.

TECHNICAL FIELD

This disclosure relates to an upper-torso garment, at least a portion of which includes a tubular-jacquard knit structure.

BACKGROUND

Upper-torso garments typically include various parts configured to cover an upper-torso region of a wearer. For example, upper-torso garments often include a chest-covering portion and a back-covering portion. In addition, upper-torso garments may include various textiles and material types, which are sometimes selected based on various properties. An example of one type of textile that may have various properties and that may be used to construct at least part of an upper-torso garment is a knit textile.

BRIEF DESCRIPTION OF THE DRAWINGS

The subject matter of this disclosure is described in detail herein with reference to the attached figures, which are incorporated herein by reference.

DETAILED DESCRIPTION

Subject matter is described throughout this disclosure in detail and with specificity in order to meet statutory requirements. But the aspects described throughout this disclosure are intended to be illustrative rather than restrictive, and the description itself is not intended necessarily to limit the scope of the claims. Rather, the claimed subject matter might be practiced in other ways to include different elements or combinations of elements that are equivalent to the ones described in this disclosure. In other words, the intended scope of the claims, and the other subject matter described in this specification, includes equivalent features, aspects, materials, methods of construction, and other aspects not expressly described or depicted in this application in the interests of concision, but which would be understood by an ordinarily skilled artisan in the relevant art in light of the full disclosure provided herein as being included within the scope. It will be understood that certain features and subcombinations are of utility and may be employed without reference to other features and subcombinations. This is contemplated by and is within the scope of the claims.

At a high level, this disclosure describes an upper-torso garment having various elements that contribute to the operation of the article, both independently of, and in combination with, one another. For example, the upper-torso garment includes one or more portions constructed with a tubular-jacquard knit structure. In an aspect of the disclosure, the manner in which one or more yarn strands are interlooped and transferred between front and back courses in accordance with the tubular-jacquard knit structure affects the properties of the upper-torso garment. Other elements may also affect the properties of the garment, including (but not limited to) the yarn composition and size, additional knit structures, and stitch size, which will be described in more detail in other parts of this disclosure. Among other things, the tubular-jacquard knit structure and other elements may contribute to a fit and shape of the garment, as well as to textile properties, such as elongation, compression, breathability, elasticity, stability, support, and the like.

Figure 1:
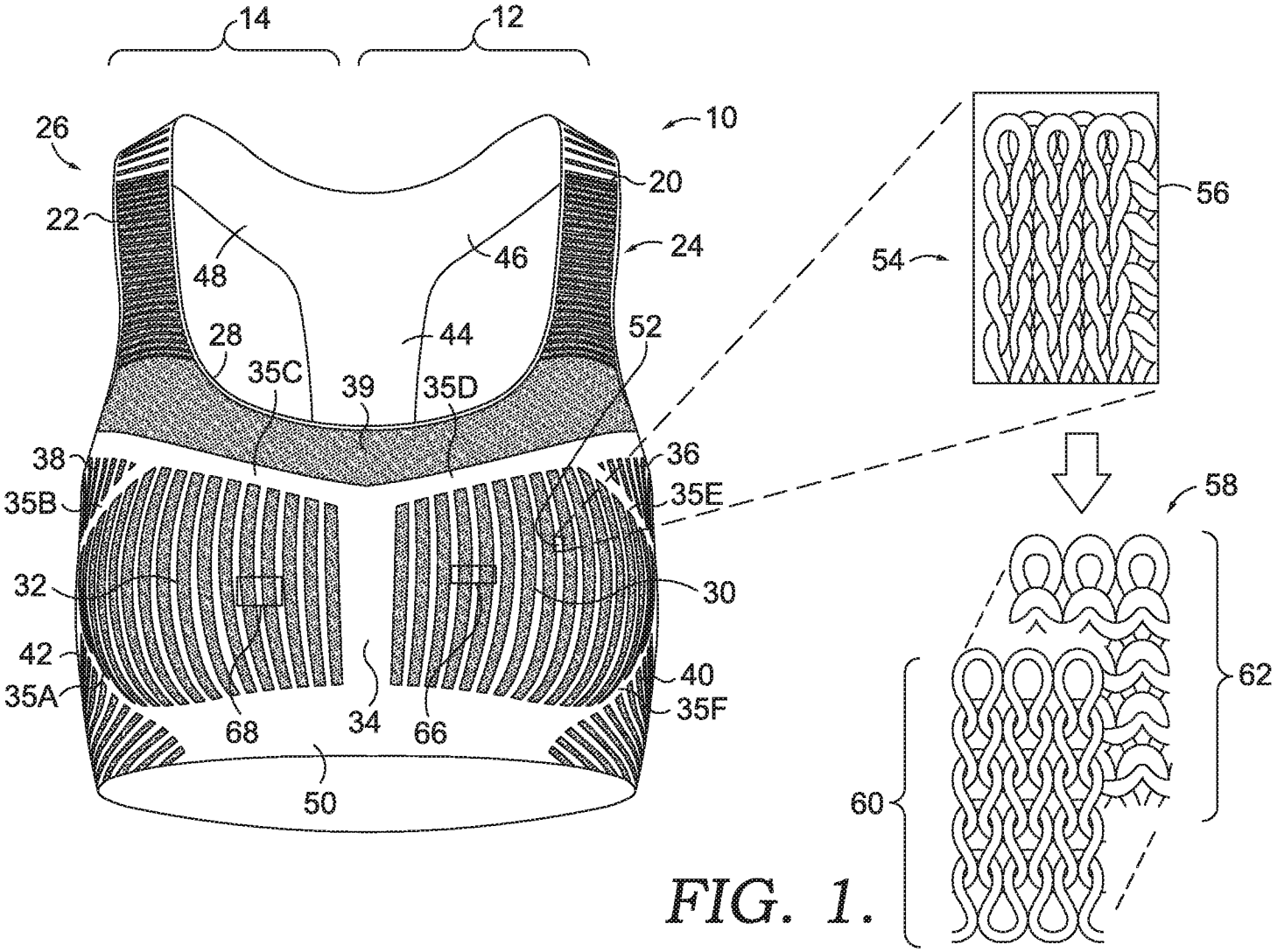
FIG. 1 depicts a front view of an upper-torso garment in accordance with an aspect of this disclosure.
Figure 3:
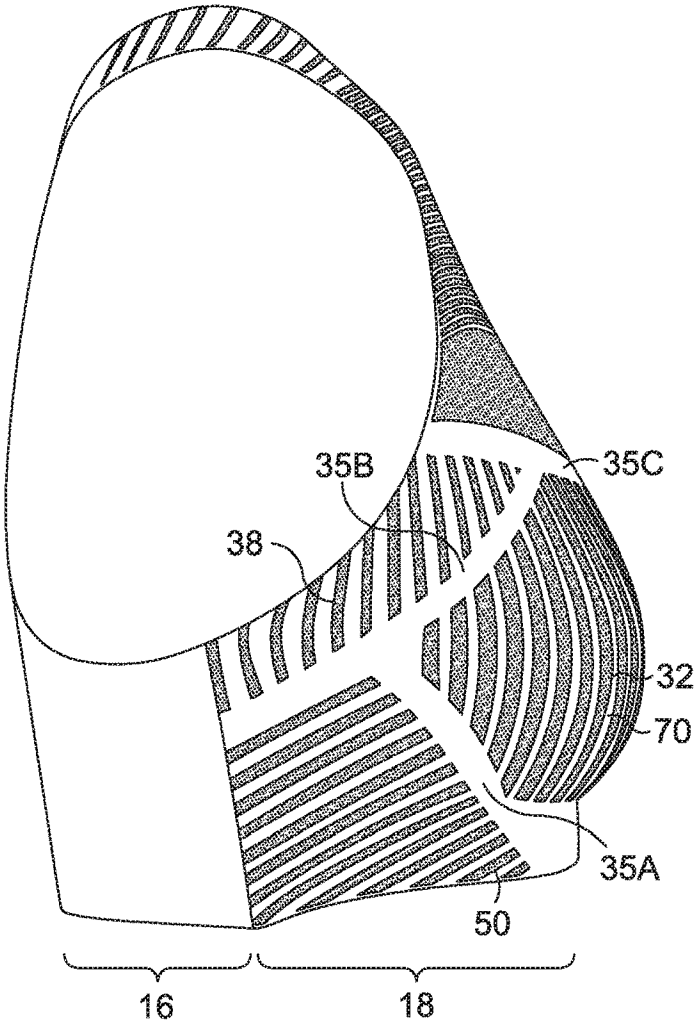
FIG. 3 depicts a side view of the garment depicted in FIG. 1.
Figure 2:
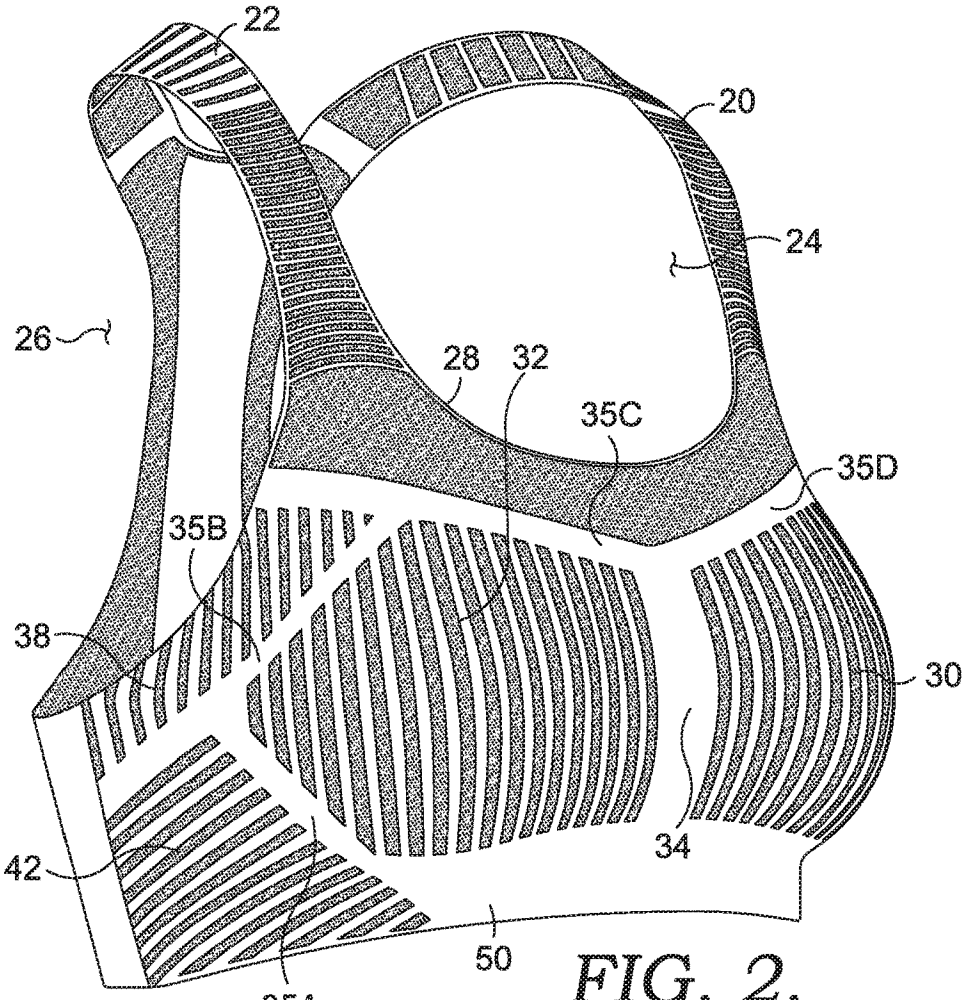
FIG. 2 depicts a front perspective view of the garment depicted in FIG. 1.

Referring initially to FIGS. 1-3, an exemplary upper-torso garment 10 is depicted, and in this description, "upper-torso garment" describes any garment configured to cover an upper-torso of a wearer. The illustrated upper-torso garment 10 is a bra, and the style of bra depicted is sometimes referred to as a sports bra, athletic bra, or other similar designation. And in other aspects of this disclosure, an upper-torso garment may include various other types of garments for a female or male, including a strapless bra, a camisole, a base-layer shirt, a singlet, a racing suit, and the like.

When describing various aspects of the upper-torso garment 10, relative terms may be used to aid in understanding relative positions. For instance, the upper-torso garment 10 may be divided into a left side 12 and a right side 14. In addition, the upper-torso garment 10 may include a posterior portion 16, which typically covers at least part of a wearer's back when the upper-torso garment 10 is in an in-use state, and an anterior portion 18 that typically covers at least part of a wearer's chest in the in-use state.

Furthermore, the upper-torso garment 10 includes various parts that may also be referred to when describing aspects of the disclosure. For instance, the upper-torso garment 10 includes shoulder straps 20 and 22, as well as arm holes 24 and 26 and a neckline 28, which generally forms a perimeter around a neck-receiving aperture. In addition, the upper-torso garment 10 includes a breast-covering portion 30 on the left side 12 and a breast-covering portion 32 on the right side 14, and a center bridge 34 is positioned between the breast-covering portions 30 and 32. The upper-torso garment 10 also includes a series of encapsulation regions 35A, 35B, 35C, 35D, 35E, and 35F that form a perimeter around at least a portion of the breast-covering portions 30 and 32. In some instances, the combination of the breast-covering portions, the center bridge, and the encapsulation regions may collectively form a chest-covering portion.

Moreover, the upper-torso garment 10 includes an upper-chest portion 39, a left underarm portion 36, a right underarm portion 38, a left wing 40, and a right wing 42. The posterior portion 16 includes a racerback-style rear panel having a main trunk 44 with rear straps 46 and 48. The trunk 44 and the rear straps 46 and 48 generally form a "T" shape or a "Y" shape, and the straps 46 and 48 connect with the shoulder straps 20 and 22. A chest band 50 extends circumferentially beneath the breast-covering portions 30 and 32 and the wings 40 and 42 and wraps entirely around to the posterior portion 16. The chest band 50 is illustrated without any clasp or other releasable connector, which might be included in an alternative aspect. These relative regions and parts are not necessarily intended to demarcate precise areas of the upper-torso garment 10, and they are provided for explanatory and illustrative purposes. However, the upper-torso garment 10 may include structural elements, such as seams or transition zones, that provide logical divisions or demarcation.

The upper-torso garment 10 may include other parts, regions, and portions that are not necessarily denoted in FIGS. 1-3, such as a cradle region, underwire, and the like. In addition, as indicated above, the bra-style, upper-torso garment 10 depicted in FIGS. 1-3 is merely illustrative of type of upper-torso garment, and in other aspects of this disclosure, an upper-torso garment may have sleeves, an abdomen-covering portion, a lumbar-covering portion, integral shorts or pants (e.g., such as in a unitard), and the like.

In an aspect of this disclosure, the upper-torso garment 10 includes a knit-textile region, and as used in this disclosure, "knit-textile region" generally refers to at least a portion of the upper-torso garment 10 constructed of one or more yarn strands that are interlooped with one another. For instance, in FIG. 1 an exemplary knit-textile region 52 is identified, and additional details of the knit-textile region 52 are further depicted in a magnified view 54, which illustrates an exemplary knit structure 56. As depicted by the partially exploded view 58, the knit structure 56 includes courses of interlooped front stitches 60 and courses of interlooped back stitches 62.

The knit textile region 52 is identified in FIG. 1 for illustrative purposes to allow for the depiction and explanation of knit structures, and in other aspects of this disclosure, the upper-torso garment 10 includes one or more other knit-textile regions that are larger than the region 52 and/or are positioned in other regions and parts of the upper-torso garment 10. For example, at least some of the anterior portion of the upper-torso garment 10 may include one or more knit structures, including the chest band 50, breast-covering portions 30 and 32, center bridge 34, encapsulating regions 35A-F, underarm portions 36 and 38, wings 40 and 42, straps 20 and 22, and any combination thereof. These parts of the upper-torso garment 10 may be integrally knit as a continuous knit panel or may be separate knit panels.

In an aspect of the present disclosure, the breast-covering portions 30 and 32 each include a knit textile region 66 and 68. The breast-covering portions 30 and 32 include various features that may identify the breast-covering portions. For example, the breast-covering portions 30 and 32 are generally positioned superior to the chest band 50 and inferior to the straps 20 and 22. In addition, the breast-covering portions 30 and 32 are generally on the anterior side of the upper-torso garment 10, between the underarm portions 36 and 38 and between the wings 40 and 42. Furthermore, as suggested by FIGS. 1-3, the breast-covering portions 30 and 32 may be separated by a center bridge 34 and may be bordered on one or more sides by an encapsulation regions 35A-F. And in some other aspects, the center bridge 34 may be omitted, such that the breast-covering portions 30 and 32 form a single breast-covering portion that spans the anterior side from left-side wings and underarm portions to the right-side wings and underarm portions. Likewise, the thickness of the encapsulation regions 35A-F may be reduced, or the encapsulating regions may be omitted in other aspects of the disclosure. As illustrated by the side views of FIG. 2 and FIG. 3, the breast-covering portions 30 and 32 are dome-shaped and include a convex exterior surface 70, and as such include a concave interior surface that is not viewable in the perspectives shown in FIGS. 1-3.

The breast-covering portions 30 and 32 may cover and possibly contact a chest region of the wearer when the upper-torso garment 10 is in an in-use state, such as when donned by a human or mannequin. Furthermore, the breast-covering portions 30 and 32 may provide compressive support to respective breast tissue of a wearer. The size and shape of the breast-covering portions 30 and 32 depicted in FIGS. 1-3 is illustrative of one aspect of the subject matter described herein, and in other aspects, the size and shape may be varied.

Figure 4:
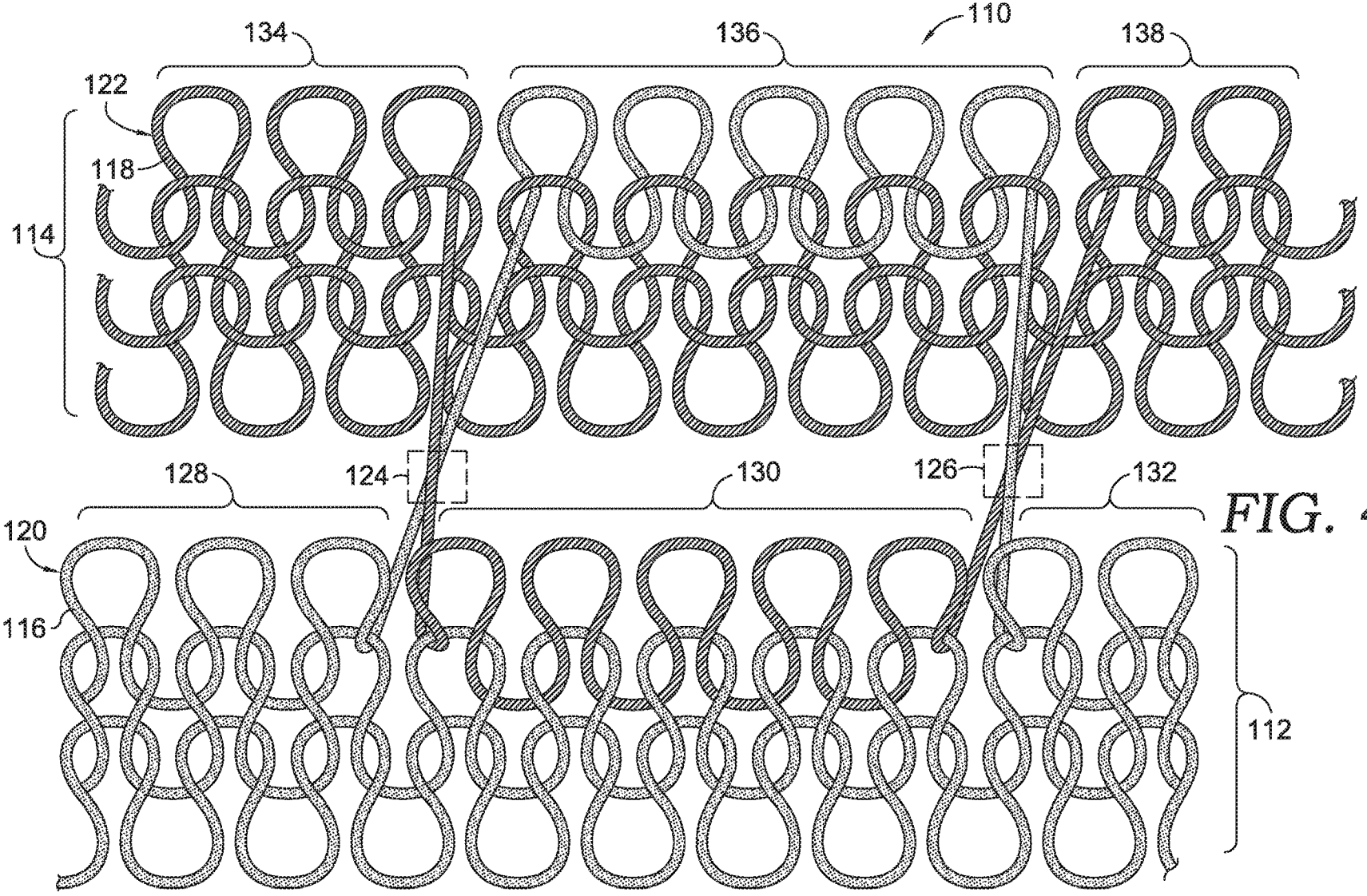
FIG. 4 depicts an exemplary knit schematic in accordance with an aspect of this disclosure.

In a further aspect of this disclosure, the knit textile regions 66 and 68 include a tubular-jacquard knit structure. Referring to FIG. 4 a schematic is depicted that illustrates some features of an exemplary tubular-jacquard knit structure 110. The tubular-jacquard knit structure 110 includes a plurality of front-stitch courses 112 and a plurality of back-stitch courses 114, which are constructed of a first yarn strand 116 and a second yarn strand 118. Furthermore, FIG. 4 depicts that one of the front-stitch courses 120 intermittently interlocks with one of the back-stitch courses 122 by way of the first yarn strand 116 extending from the front-stitch course 120 to the back-stitch course 122. In addition, at a location corresponding with the first yarn strand 116 extending to the back-stitch course 122, the second yarn strand 118 extends from the back-stitch course 122 to the front-stitch course 120.

In accordance with an aspect of this disclosure, this structure in which the first yarn strand 116 extends from the front-stitch course 120 to the back-stitch course 122 and the second yarn strand 118 extends from the back-stitch course 122 to the front-stitch course 120 is referred to as an "interlocking cross over," which is identified by reference numeral 124. In FIG. 4, another interlocking cross over 126 is illustrated in which the first yarn strand 116 extends from the back-stitch course 122 to the front-stitch course 120, and the second yarn strand 118 extends from the front-stitch course 120 to the back-stitch course 122.

In accordance with an aspect of this disclosure, interlocking cross overs separate a front-stitch course into subsets of, or sub-quantities of, front stitches. For example, the interlocking cross overs 124 and 126 divide the front-stitch course 120 into a first quantity of front stitches 128, a second quantity of front stitches 130, and a third quantity of front stitches 132. Likewise, the back-stitch course 122 is divided into a first quantity of back stitches 134, a second quantity of back stitches 136, and a third quantity of back stitches 138.

In FIG. 4, the first yarn strand 116 is depicted having a different appearance than the second yarn strand 118. For example, the first yarn strand 116 may be a different color than the second yarn strand 118. In an aspect of this disclosure, the difference in appearance between the two yarn strands 116 and 118 results in a striping pattern when the first and second yarn strands intermittently switch back and forth between the front course and the back course, such as the illustrative striping patterns in FIGS. 1-3 in the breast-covering portions 30 and 32, underarm portions 36 and 38, and wings 40 and 42. The upper-torso garment 10 in FIGS. 1-3 is merely exemplary of one striping pattern that might be achieved, and in other aspects, an upper-torso garment might have a different pattern. In addition, the first yarn strand and the second yarn strand might have the same or similar appearance, such that a visual striping pattern is not created by the switching back and forth of the first yarn strand and the second yarn strand between the front and back courses.

Figure 5:
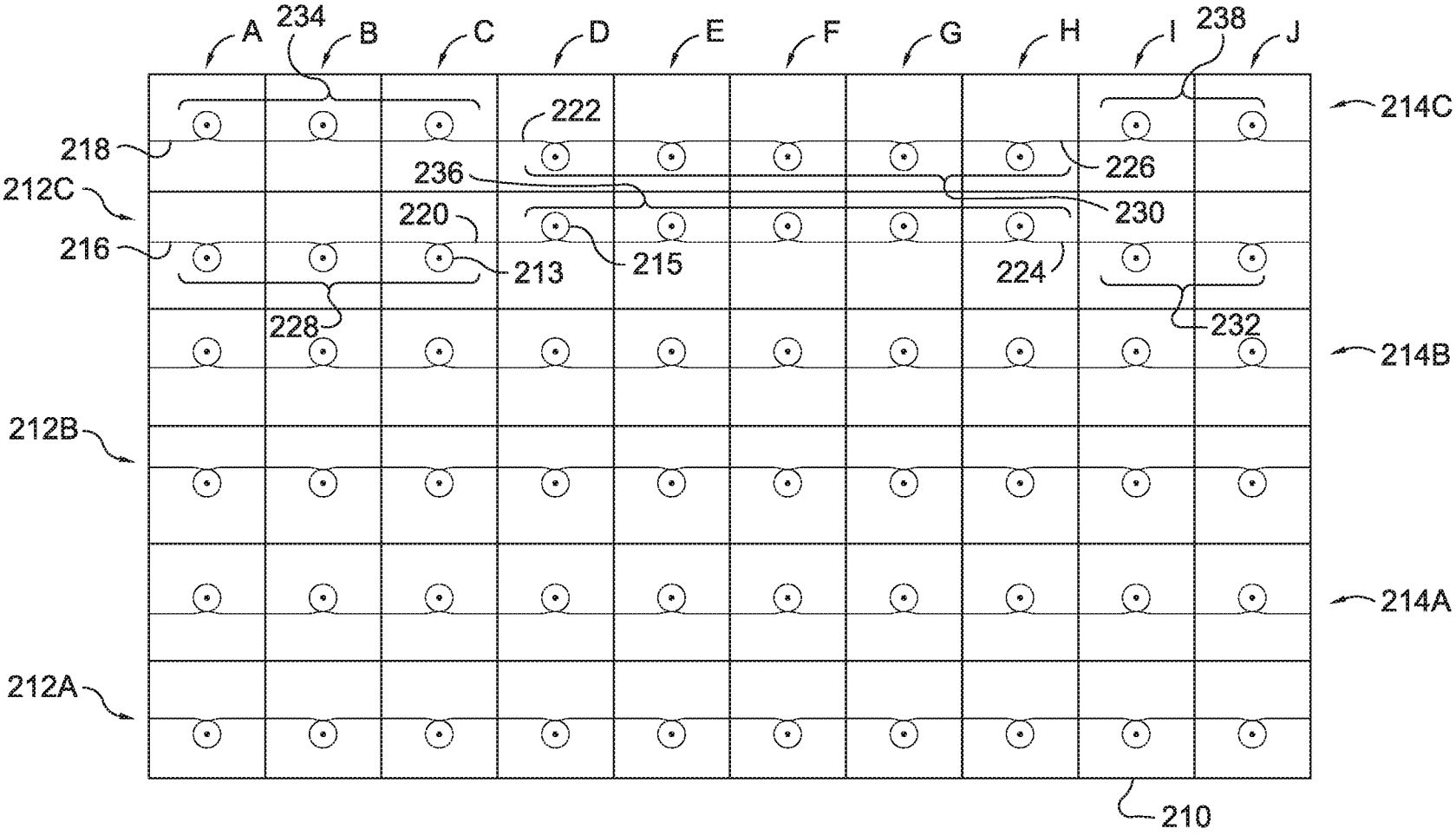
FIG. 5 depicts knit-program notations corresponding with the knit schematic in FIG. 4.

Referring now to FIG. 5, an exemplary knit diagram 210 is depicted corresponding with the tubular-jacquard knit structure 110 of FIG. 4. The knit diagram 210 includes a plurality of columns and rows. Each column represents a needle position and each row represents a yarn strand. The rows alternate between a first yarn strand and a second yarn stand, which are used to form the tubular-jacquard knit. Within each row, the stitch type is designated, together with an indication of whether the stitch is on the front bed or the back bed. A stitch notation beneath the "yarn" is on the front bed, and a stitch notation above the "yarn" is on the back bed. For example, a row 212C designates stitch type and stitch location for a first yarn strand 216 at ten needle positions A-J. The stitch notation 213 designates a stitch on the front bed, and the stitch notation 215 designates a stitch on the back bed. As such, the line segment 220 would correspond with the transfer from the front bed to the back bed.

Continuing with FIG. 5, each of the rows 212A-C prescribes knit structures for the first yarn strand 216, and the alternating rows 214A-C prescribe knit structures for a second yarn strand 218. The rows 212A and 212B prescribe ten stitches with the first yarn strand 216 on the front side of the knit structure, and the rows 214A and 214B prescribe ten stitches with the second yarn strand 218 on the back side of the knit structure. These rows 212A, 212B, 214A and 214B correspond with the first two front-stitch courses and the first two back-stitch courses in FIG. 4.

As previously described, row 212C designates stitches for the first yarn strand 216, which corresponds with the first yarn strand 116 of FIG. 4. As such, the row 212C sequentially designates three stitches on the front side, a transfer to the back side (i.e., line segment 220), five stitches on the back side, a transfer to the front side (i.e., line segment 224), and two stitches on the front side. Row 214C designates stitches for the second yarn strand 218, which corresponds with the second yarn strand 118 of FIG. 4, and as such, the row 214C sequentially designates three stitches on the back side, a transfer to the front side (i.e., line segment 222), five stitches on the front side, a transfer to the back side (i.e., line segment 226), and two stitches on the back side. When executed, the transfers designated by 220 and 222 translate into the interlocking cross over 124, and the transfers designated by 224 and 226 translate into the interlocking cross over 126. Accordingly, the combination of the stiches prescribed by the rows 212C and 214C translate to the front-stitch course 120 of FIG. 4 and the back-stitch course 122 of FIG. 4.

As described with respect to FIG. 4, interlocking cross overs separate a course into subsets of stitches. For example, in FIG. 5 the transfers 220, 222, 224, and 226 separate the interlocked course into a first quantity of front stitches 228, a second quantity of front stitches 230, a third quantity of front stitches 232, a first quantity of back stitches 234, a second quantity of back stitches 236, and a third quantity of back stitches 238.

Figure 6A:
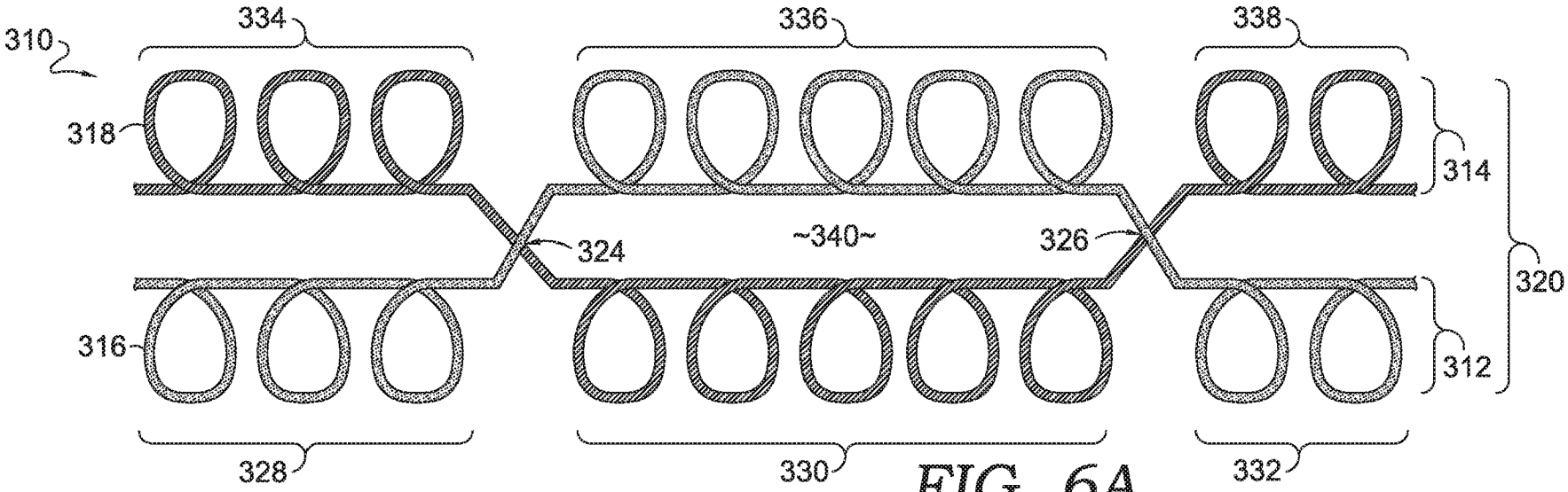
FIGS. 6A and 6B depict knit schematics illustrating interlocking cross overs of a front course and a back course in accordance with an aspect of this disclosure.

To further illustrate an exemplary tubular-jacquard knit structure 310, FIG. 6A includes another schematic of a front-stitch course 312 and a back-stitch course 314, which provide an alternative visual representation of the front-stitch course 120 and the back-stitch course 122 depicted in FIG. 4. The front-stitch course 312 and the back-stitch course 314 are formed of a first yarn strand 316 and a second yarn strand 318, and the first-stitch course 312 is intermittently interlocked with the back-stitch course 314 to form an interlocked course 320. The interlocked course 320 includes an interlocking cross over 324 of the yarn strands 316 and 318 that corresponds with the interlocking cross over 124 (FIG. 4) and another interlocking cross over 326 that corresponds with the interlocking cross over 126 (FIG. 4).

Furthermore, FIG. 6A illustratively depicts that the interlocking cross overs 324 and 326 divide the interlocked course into a first quantity of front stitches 328, a second quantity of front stitches 330, a third quantity of front stitches 332, a first quantity of back stitches 334, a second quantity of back stitches 336, and a third quantity of back stitches 338. Within the interlocked course 320, the combination of the interlocking cross overs 324 and 326, the second quantity of front stitches 330, and the second quantity of back stitches 336 substantially partition off a space 340 between the two courses 312 and 314.

Figure 6B:
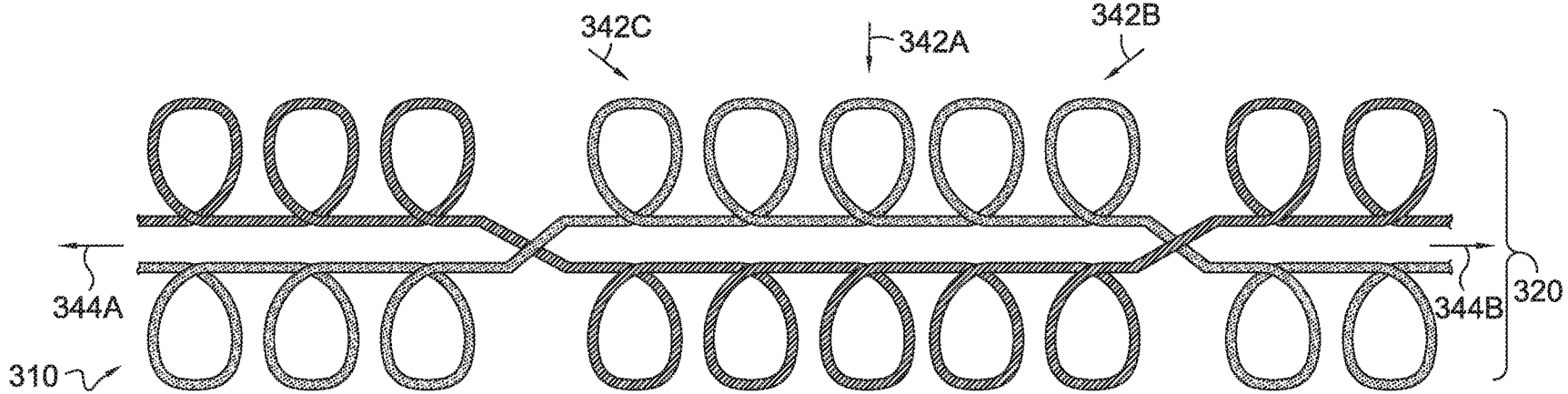

Referring to FIG. 6B, the knit structure 310 operates in various manners when subjected to a force. For example, when a force is applied in a direction (e.g., 342A, 342B, or 342C) that intersects the interlocked course 320 the knit structure 310 elongates in a direction (e.g., 344A and 344B) aligned with the interlocked course 320. In addition, when the force is removed, the knit structure 310 returns to its resting state. In one aspect of the disclosure, the interlocking cross overs 324 and 326 contribute to this property of the knit structure 310 by way of the first yarn strand 316 and the second yarn strand 318 mechanically altering from a first state (e.g., FIG. 6A) that is more bent or curved to a second state (e.g., FIG. 6B) that is straighter. In this sense, interlocking cross overs 324 and 326 function similar to expansion joints between the subsets of stitches.

When a knit-textile region having the knit structure 310 is constructed into the upper-torso garment 10, a force might be applied to the knit structure in various contexts. For example, a force might be applied in a direction that intersects the interlocked course 320 when the upper-torso garment is donned and a portion of the wearer (e.g., breast tissue) presses against the knit-textile region. As such, the knit-textile region mechanically stretches or elongates to fit the wearer and may provide a compressive force against the wearer.

In an aspect of the present disclosure, a density of interlocking cross overs (e.g., number of interlocking cross overs in a given knit region) included among a knit textile region is selected to achieve an amount of mechanical stretch and elongation and compressive force against a wearer's tissue (e.g., breast tissue). That is, a first interlocked course that includes more interlocking cross overs among a given number of stitches will elongate more than a second interlocked course with a fewer number of interlocking cross overs in the given number of stitches when the first and second interlocked courses are subjected to the same force. As such, the second interlocked course may provide more compression than the first interlocked course under the same conditions (e.g., garment size and wearer dimensions), and the first interlocked course may mechanically elongate more than the second interlocked course. Applying these principles, an aspect of the present disclosure includes an upper-torso garment including one or more tubular-jacquard knit structures, which provide a respective amount of elongation based at least in part on the density of interlocking cross overs.

Figure 7A:
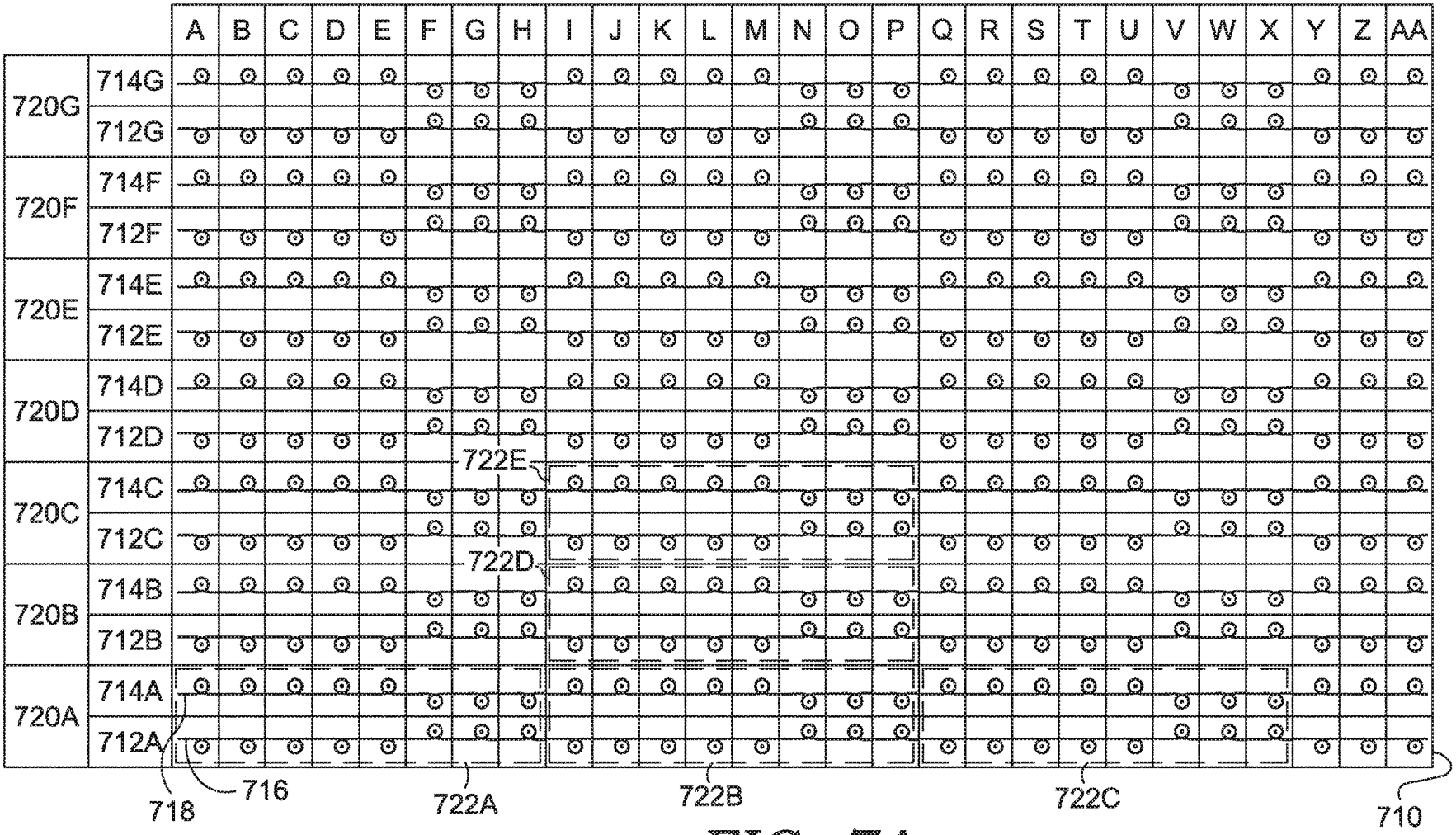
FIG. 7A depicts knit-program notations in accordance with an aspect of this disclosure.
Figure 7B:
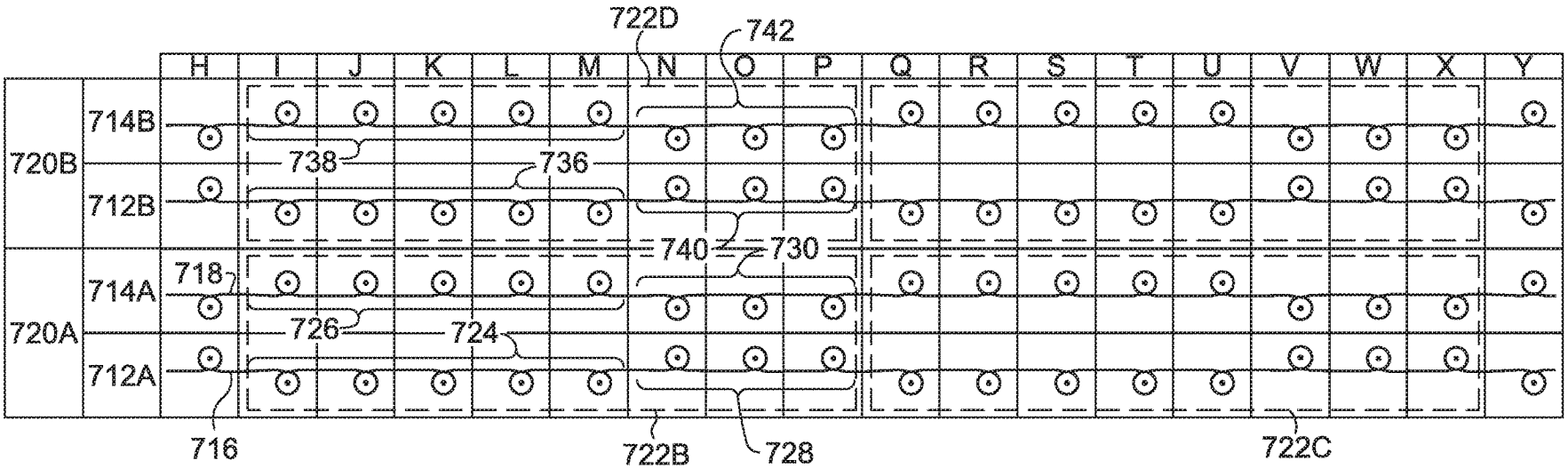
FIG. 7B depicts a magnified view of a portion of the schematic of FIG. 7A.

Referring to FIG. 7A a knit diagram 710 depicts a plurality of first-strand rows 712A-G that represent stitches formed with a first yarn strand 716 and a plurality of second-strand rows 714A-G that prescribe stitches formed with a second yarn strand 718. In addition, the knit diagram 710 includes a plurality of consecutively arranged needle positions (A-AA). When executed, a corresponding first-strand row (e.g., 712A) and a corresponding second-strand row (e.g., 714A) translate into a front-stitch course and back-stitch course, which include a density of interlocking cross overs. FIG. 7B includes a magnified view of a portion of the knit diagram 710, including the first-strand rows 712A-B, the second-strand rows 714A-B, and the subset of needle positions H-Y.

The first-strand stitches designated in the first-strand row 712A intermittently interlock with the second-strand stitches designated in the second-strand row 714A to form an interlocked course 720A. In addition, the interlocked course 720A includes an intra-course knit sequence that repeats along the interlocked course 720A. The intra-course knit sequence that repeats is outlined by a box 722A (FIG. 7A), and the repeating instances of the intra-course knit sequence are outlined by boxes 722B and 722C. FIG. 7B also illustrates the repeating intra-course knit sequences outlined by the boxes 722B and 722C. In accordance with an aspect of the disclosure, the structure of the intra-course knit sequence, as well as the repeating instances, contribute to the density of interlocking cross overs within the interlocked course.

Referring to FIG. 7B, the intra-course knit sequence (identified by the box 722B) includes a first quantity of front stitches 724 formed by the first yarn strand 716 and a first quantity of back stitches 726 formed by the second yarn strand 718. Furthermore, between the needle positions M and N, the first yarn strand 716 transfers from the front bed to the back bed, and the second yarn strand 718 transfers from the back bed to the front bed. The first yarn strand 716 then forms a second quantity of back stitches 728, and the second yarn strand 718 forms a second quantity of front stitches 730. The first yarn strand 716 and the second yarn strand 718 then cross back over after the second quantity of front stitches 730 and the second quantity of back stitches 728 and between the needle positions P and Q. The intra-course knit sequence then repeats at least once in the interlocked course after the crossing back over between the needle positions P and Q.

In the exemplary knit diagram 710, the quantity of front stitches in the intra-course knit sequence is eight (e.g., front stitches provided from needles I to P), and the quantity of back stitches in the intra-course knit sequence is eight. In addition, there is a single interlocking cross over among those eight front stitches and eight back stitches, prior to a second interlocking cross over initiating the repeating instance of the intra-course knit sequence. The intra-course knit sequence depicted in FIGS. 7A and 7B is merely exemplary of one aspect of the present disclosure, in which a knit textile region formed according to the structure prescribed by the knit diagram 710 includes an amount of elongation and compression properties resulting at least in part from the repeating pattern of eight front stitches, eight back stitches, and an interlocking cross over among the eight front and back stitches. And in other aspects of the disclosure, each respective intra-course knit sequence includes a quantity of front stitches equal to or greater than 4 and less than or equal to 12 and a quantity of back stitches equal to or greater than 4 and less than or equal to 12. The quantity of front stitches and back stitches in a repeating sequence may be selected and tuned based at least in part on an amount of compression to be provided by a knit textile region that will include the repeating sequence.

In FIGS. 7A and 7B, the knit diagram 710 depicts notations for a plurality of interlocked courses 720A-720G and each interlocked course includes its own respective intra-course knit sequence (e.g., 722A, 722D, and 722E) that repeats along the respective interlocked course. In accordance with an aspect of the present disclosure, the first quantity of front stiches, the first quantity of back stitches, the second quantity of front stitches, and the second quantity of back stitches are all consistent among each of the respective intra-course knit sequences. For example, the interlocked course 720A includes an intra-course knit sequence 722A having five front stitches in a first quantity of front stitches 724, five back stitches in a first quantity of back stitches 726, three front stitches in a second quantity of front stitches 730, and three back stitches in a second quantity of back stitches 728. In a consistent manner, another interlocked course 720B includes an intra-course knit sequence (identified by box 722D) having five front stitches in a first quantity of front stitches 736, five back stitches in a first quantity of back stitches 738, three front stitches in a second quantity of front stitches 740, and three back stitches in a second quantity of back stitches 742.

In knit structures in which the respective intra-course knit sequences (e.g., the sequence in box 722A and the sequence in the box 722D), each of which is positioned in a respective interlocked course, include an equivalent number of stitches in each of the front and back stitch subsets, various arrangements may be implemented. For example, in FIGS. 7A and 7B, the interlocking cross overs of the interlocked courses 720A and 720B are positioned between the same pairs of needle positions M and N in adjacent interlooped courses. In addition, in all of the intra-course knit sequences 722A, 722D, and 722E the total number of front stitches and the total number of back stitches in a given intra-course knit sequence (i.e., eight front stitches and eight back stitches) are divided to create subsets having different quantities of stitches in the subsets (i.e., five stitches in one of the front-stitch subsets and three stitches in the other front-stitch subset).

Figure 8A:
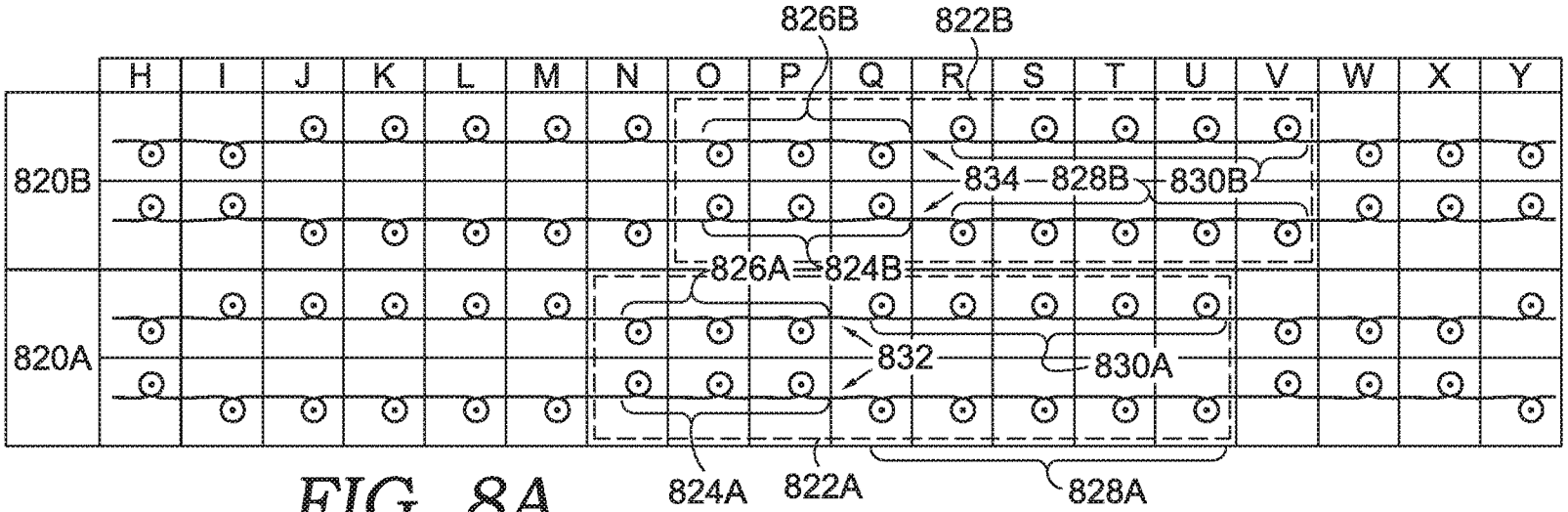
FIGS. 8A-8D each depicts additional knit schematics showing alternative knit structures in accordance with other aspects of this disclosure.

Referring now to FIG. 8A, an alternative aspect is depicted in which a tubular-jacquard knit structure includes a first interlocked course 820A interloopedly coupled to a second interlocked course 820B. The interlocked courses are interloopedly coupled by way of the interlooping of the front-stitch courses and the interlooping of the back-stitch courses. The first and second interlocked courses 820A and 820B include respective intra-course knit sequences 822A and 822B that repeat in the respective interlocked course. Similar to the knit diagram in FIGS. 7A and 7B, the first quantity of front stiches 824A and 824B, the first quantity of back stitches 826A and 826B, the second quantity of front stitches 828A and 828B, and the second quantity of back stitches 830A and 830B are all consistent among each of the respective intra-course knit sequences. And in the alternative aspect depicted in FIG. 8A, the crossing over 832 (which will form the interlocking cross over) in the first interlocked course 820A is positioned at a different needle position as the crossing over 834 in the second interlocked course 820B. Even though the interlocking cross overs are positioned between different pairs of adjacent needle positions, the interlocked courses 820A and 820B include a same density of interlocking cross overs among a given number of repeating intra-course knit sequences, and as such, the interlocked courses 820A and 820B have similar elongation and compression properties when constructing part of a knit textile region. For example, between 16 needle positions that include two sets of repeating intra-course knit sequences, both interlocked courses 820A and 820B include three interlocking cross overs.

Figure 8B:
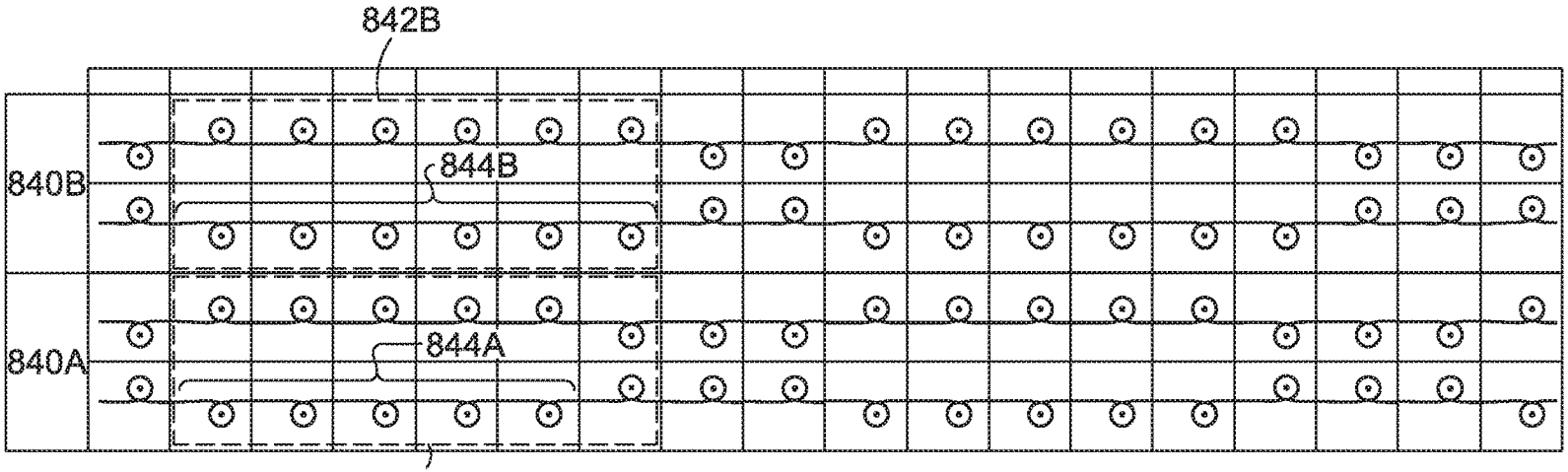

Referring now to FIG. 8B, another alternative aspect is depicted in which a tubular-jacquard knit structure includes a first interlocked course 840A interloopedly coupled to a second interlocked course 840B, and the first and second interlocked courses include respective intra-course knit sequences 842A and 842B that repeat in the respective interlocked course. The knit diagram of FIG. 8B is similar to the knit diagram of FIG. 7B, since the total quantity of stitches in the respective intra-course knit sequences are the same (i.e., eight front stitches and eight back stitches). However, the knit diagram of FIG. 8B is different from the knit diagram in FIGS. 7B and 8A, as subsets of front and back stiches are divided differently in each of the intra-course knit sequences 842A and 842B. For example, the first quantity of front stiches 844A of the intra-course knit sequence 842A is different from the first quantity of front stitches 844B of the intra-course knit sequence 842B. Even though the front and back stitch subsets are divided differently as between the interlocked courses 840A and 840B, the interlocked courses 840A and 840B include a same density of interlocking cross overs among a given number of repeating intra-course knit sequences. For example, both interlocked courses 840A and 840B include three interlocking cross overs among two repeating instances of the respective intra-course knit sequence, which is also consistent with the knit diagrams in FIGS. 7B and 8A. As such the interlocked courses 720A, 820A, and 840A may have similar elongation and compression properties when constructing knit textile regions.

Figure 8C:
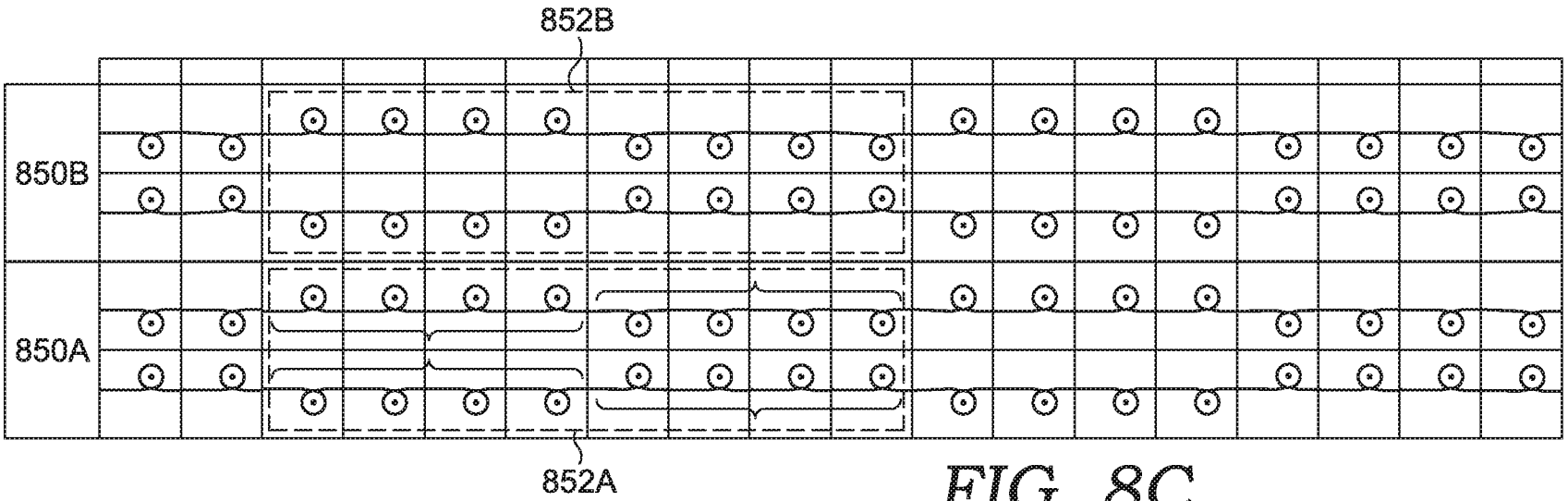

Referring now to FIG. 8C, another alternative aspect is depicted in which a tubular-jacquard knit structure includes a first interlocked course 850A interloopedly coupled to a second interlocked course 850B, and the first and second interlocked courses include respective intra-course knit sequences 852A and 852B that repeat in the respective interlocked course. The knit diagram of FIG. 8C is similar to the knit diagrams of FIGS. 7B, 8A, and 8B in that the total quantity of stitches in the respective intra-course knit sequences are the same (i.e., eight front stitches and eight back stitches). However, the knit diagram of FIG. 8C is different, since in each intra-course knit sequence, the first yarn strand constructs a same number of front stitches and back stitches (i.e., four) as the second yarn strand (i.e., four). As previously indicated, when comparing the interlocked courses of FIG. 8C to the interlocked courses of FIGS. 7B, 8A, and 8B, because the total quantity of stitches in each respective intra-course knit sequence is the same (i.e., eight front stitches and eight back stitches) and the number of interlocking cross overs is the same, the interlocked courses include a same density of interlocking cross overs among a given number repeating instances of intra-course knit sequences. As such the interlocked courses 720A, 820A, 840A, and 850A may have similar elongation and compression properties when constructing knit textile regions.

Figure 8D:
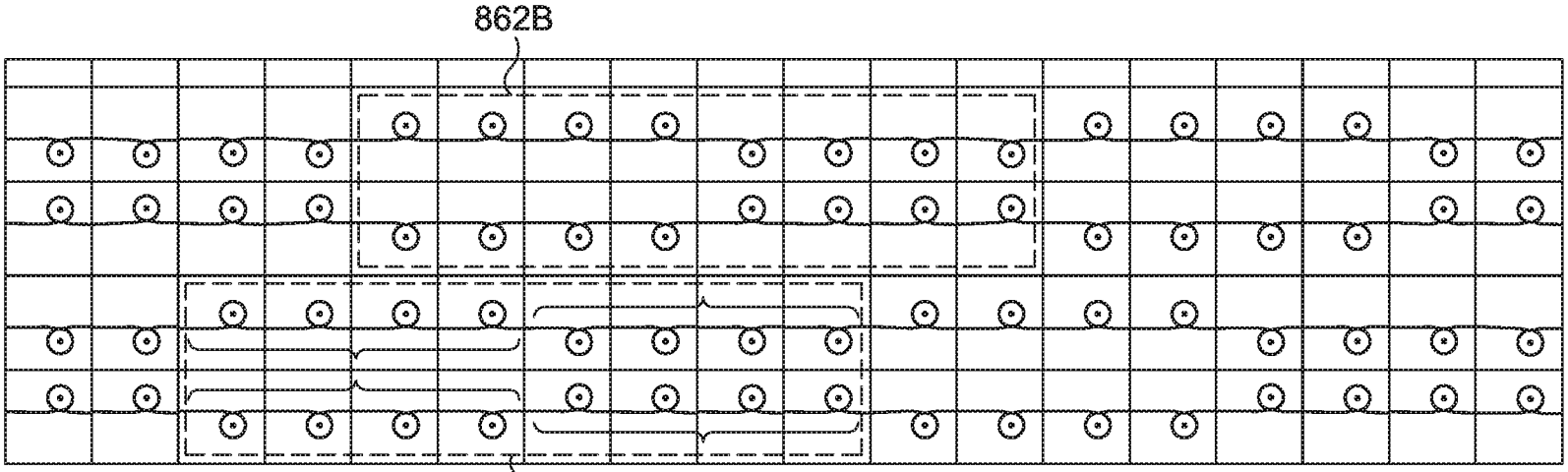

FIG. 8D illustrates a knit diagram that is similar to FIG. 8C, and in each intra-course knit sequence 862A and 862B, the first yarn strand constructs a same number of front stitches and back stitches (i.e., four) as the second yarn strand (i.e., four). But in contrast to knit sequences 852A and 852B of FIG. 8C, the intra-course knit sequences 862A and 862B include respective interlocking cross overs at between different pairs of adjacent needles. However, for the same reasons described with respect to FIG. 8A, the elongation and compression properties may be similar, since the density of interlocking cross overs is similar.

The various intra-course knit sequences illustrated by, and described with respect to, FIGS. 7A, 7B, and 8A-8D include eight front stitches and eight back stitches, and a single interlocking cross over among the eight front and back stitches. In addition, an interlocking cross over is positioned immediately prior to the intra-course knit sequence and immediately after the intra-course knit sequence. In this sense, the intra-course knit sequence is book-ended by interlocking cross overs. The illustration of eight front and back stitches is exemplary of one aspect of the disclosure, and in other aspects, the intra-course knit sequences in the knit textile regions 66 and 68 include a quantity of front stitches that is equal to or greater than four and is equal to or less than twelve. In these other aspects, the same principles described with respect to FIGS. 7A, 7B, and 8A-8D equally apply, such that the interlocking cross over of a single intra-course knit sequence may be arranged between different adjacent needle pairs to divide the front and back stitches into different sized subsets. For example, an intra-course knit sequence having twelve front stitches and twelve back stitches might be broken into two groups of six, a group of five and a group of seven, a group of four and a group of eight, etc. Further, the interlocking cross overs may be positioned between the same adjacent needle pair from one interlocked course to the next, or may be positioned at different adjacent needle pairs as between interlooped courses.

The various knit structures prescribed by FIGS. 7A-8D include a density of interlocking cross overs among a defined quantity of stitches (e.g., a defined set of needle positions). For example, each knit structure in FIGS. 7B-8D includes two front-stitch courses, each having a quantity of 13 front stitches between the needle positions H and T, and two back-stitch courses, each having 13 back stitches between the needle positions H and T. Further, the quantity of front stitches combined with the quantity of back stitches yields a quantity of 26 stitches. As such, a ratio can describe a quantity of interlocking cross overs relative to a number of stitches in a defined knit textile region. For instance, in each of the knit sequences described by the knit diagrams of FIGS. 7B-8D that include two courses having 13 needle positions, the ratio of the quantity of interlocking cross overs to the quantity of stitches is 3:13. As such, in one aspect of the present disclosure, a ratio of interlocking cross overs to a quantity of stitches may be used to assess and tune an amount of elongation in a knit textile zone.

As indicated above, FIGS. 7B-8D are merely examples of some different intra-course knit sequences having a quantity of eight front stitches and eight back stitches, and in other instances, the intra-course knit sequences may include from four to twelve stitches. Applying the same rationale of characterizing a knit textile region by a ratio of interlocking cross overs to stitches, in one aspect of the present disclosure, the ratio is in a range of about 1:4 to about 1:13.

In accordance with other aspects of the present disclosure, other properties of a knit textile region (e.g., 66 and 68) contribute in-part to an amount of elongation and compression provided by the knit textile region, in addition to the tubular-jacquard knit structure. For example, in one aspect, both the front yarn strand and the back yarn strand include a non-elastic yarn type (also sometimes referred to as a non-stretch yarn), which includes an amount of elasticity that provides a maximum stretch of less than 200% under load prior to returning to a non-stretched state when the load is removed. In a further aspect, the non-elastic yarn type of the first yarn strand and the second yarn strand provides a maximum stretch of less than 100%. Examples of non-elastic yarn types include nylon and polyester. In one aspect of the disclosure, both the first yarn strand and the second yarn strand include two ends of nylon 2/78D/68 (i.e., 2 ply where each ply is 78 decitex with 68 filaments). In contrast, elastic yarn types provide a maximum stretch greater than 200% under load prior to returning to a non-stretched state when the load is removed, and some elastic yarns provide a maximum stretch of about 400%. Examples of elastic yarns include spandex, elastane, lycra, and the like.

When the first yarn strand and the second yarn strand include a non-elastic yarn type, an amount of elongation of the knit textile panel is achievable with the mechanical elongation provided by the interlocking cross overs. Absent this aspect of the disclosure in which non-elastic yarn types are utilized, other solutions may include more elastic yarn types to achieve an amount of elongation.

In accordance with another aspect of the present invention, the stitch length may also contribute to an amount of elongation provided by a knit textile region, in addition to the elongation properties provided by the tubular-jacquard knit structure. For example, the stitch length of the front and back stitches of the knit textile regions might be in a range of about 3.00 mm to about 3.30 mm. And in one aspect of the present invention, the stitch length is 3.15 mm. These stitch lengths are merely exemplary of one aspect of the disclosure, and in other aspects, smaller or larger stitch lengths may be used.

Figure 9:
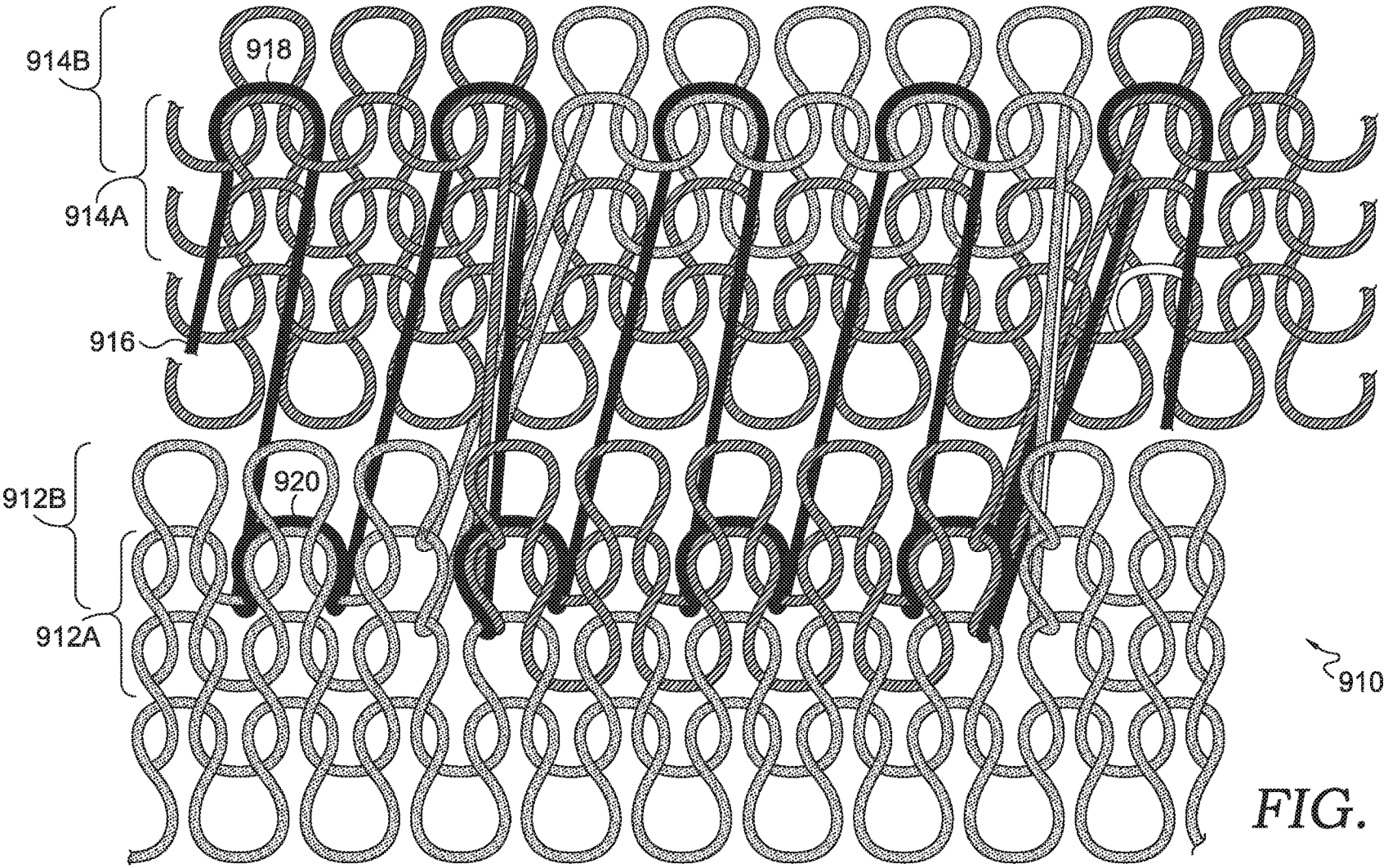
FIG. 9 depicts another exemplary knit schematic, which illustrates a tubular-jacquard knit structure having an interlocking tuck binder, in accordance with an aspect of this disclosure.

The structures that are depicted in FIGS. 7A-8D and that might be incorporated into various knit regions of the upper-torso garment include a tubular-jacquard knit structure constructed with a first yarn strand and a second yarn strand. In addition, each of the knit structures of FIGS. 7A-8D, as well as the knit-textile regions (e.g., 66 and 68) of the upper-torso garment into which they are incorporated, may include additional, integrally-knit structures. For example, referring to FIG. 9 a tubular-jacquard knit structure 910 is depicted having a plurality of front-stitch courses and a plurality of back-stitch courses. In addition, the front-stitch courses 912A and 912B are intermittently interlocked with the back-stitch courses 914A and 914B, similar to the tubular-jacquard knit structures described with respect to FIGS. 4-8D. As such, the front-stitch course 912A and the back-stitch course 914A form an interlocked course. According to another aspect of the present disclosure, each interlocked course further comprises a course of interlock tuck stitches that further binds a respective front-stitch course 912A to a respective back-stitch course 914B by interlooping with every other front stitch and every other back stitch. As depicted in FIG. 9, a third yarn strand 916 forms a tuck stitch 918 in the back-stitch course 914A and then transfers to the front-stich course 912A to form another tuck stitch 920. Further, the third yarn strand 916 transfers back and forth between the front-stitch course 912A and the back-stitch course 914A in a sinuous manner to form a tuck stitch at every other front stitch and every other back stitch. To avoid overcrowding the illustrative in FIG. 9, other courses of interlock tuck stitches are not depicted (e.g., in the course formed by the front-stitch course 912B and the back-stitch course 914B), but in other aspects of the disclosure, other courses of interlock tuck stitches might bind the front-stitch course 912B with the back-stitch course 914B, as well as the other front and back courses. Furthermore, the other course of interlock tuck stitches may be offset from the course of interlocking tuck stitches that bind the front-stitch course 912A with the back-stitch course 914A.

Figure 10:
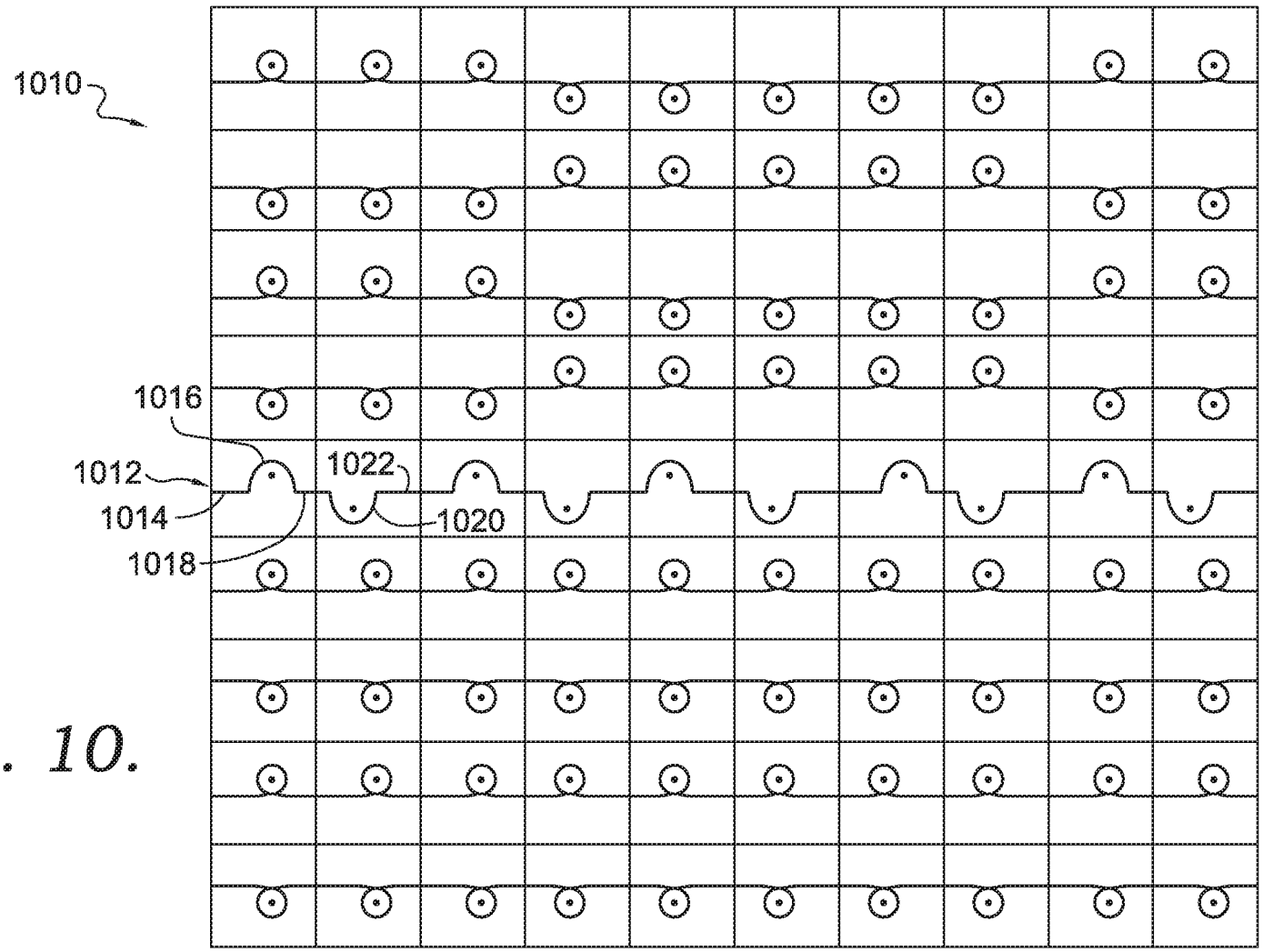
FIG. 10 depicts knit-program notations corresponding with the knit schematic in FIG. 9.

Referring to FIG. 10, a knit diagram 1010 depicts knit notations that, when executed, would result in a knit structure similar to the tubular-jacquard knit structure 910 of FIG. 9. For example, the knit diagram 1010 depicts a row 1012 that prescribes knit structures for the third yarn strand 1014. As described with respect to FIG. 9, the row indicates that the third yarn strand 1014 forms a tuck stitch 1016 on the back side, and then the third yarn strand 1014 transfers 1018 to the front side. The third yarn strand 1014 then forms a tuck stitch 1020 on the front side and transfers 1022 to the back side. This pattern repeats as the third yarn strand 1014 transfers back and forth between the front side and the back side while tuck stitching at every other front stitch and every other back stitch.

Figure 11:
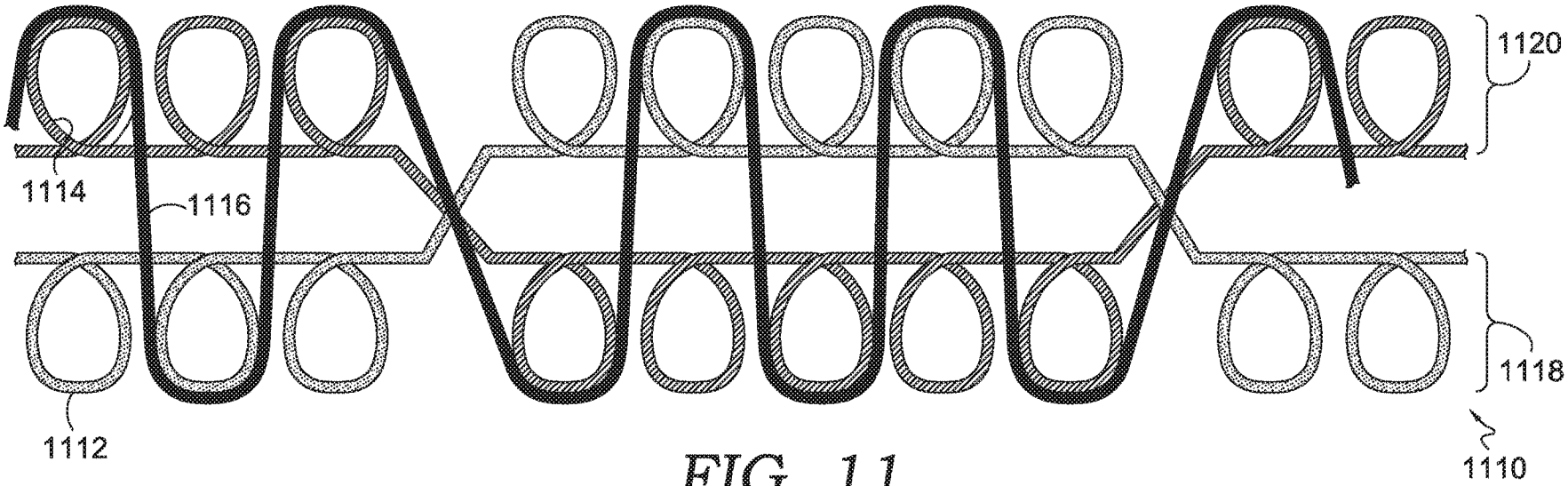
FIG. 11 depicts a knit schematic illustrating an interlocking tuck binder in combination with interlocking cross overs of a front course and a back course in accordance with an aspect of this disclosure.

FIG. 11 provides another illustrative schematic of a tubular-jacquard knit structure 1110 that corresponds with the front-stitch course 912A and the back-stitch course 914B in FIG. 9 and that includes a first yarn strand 1112, a second yarn strand 1114, and a third yarn strand 1116. The first yarn strand 1112 and the second yarn strand 1114 are knit to form a structure similar to the knit structure 310 of FIG. 6, including a front-stitch course 1118 and a back-stitch course 1120 that intermittently interlock to form an interlocked course. In addition, the third yarn strand 1116 binds the front-stitch course 1118 and the back-stitch course 1120 by constructing a series of interlock tuck stitches at every other front stitch and every other back stitch.

Figure 12:
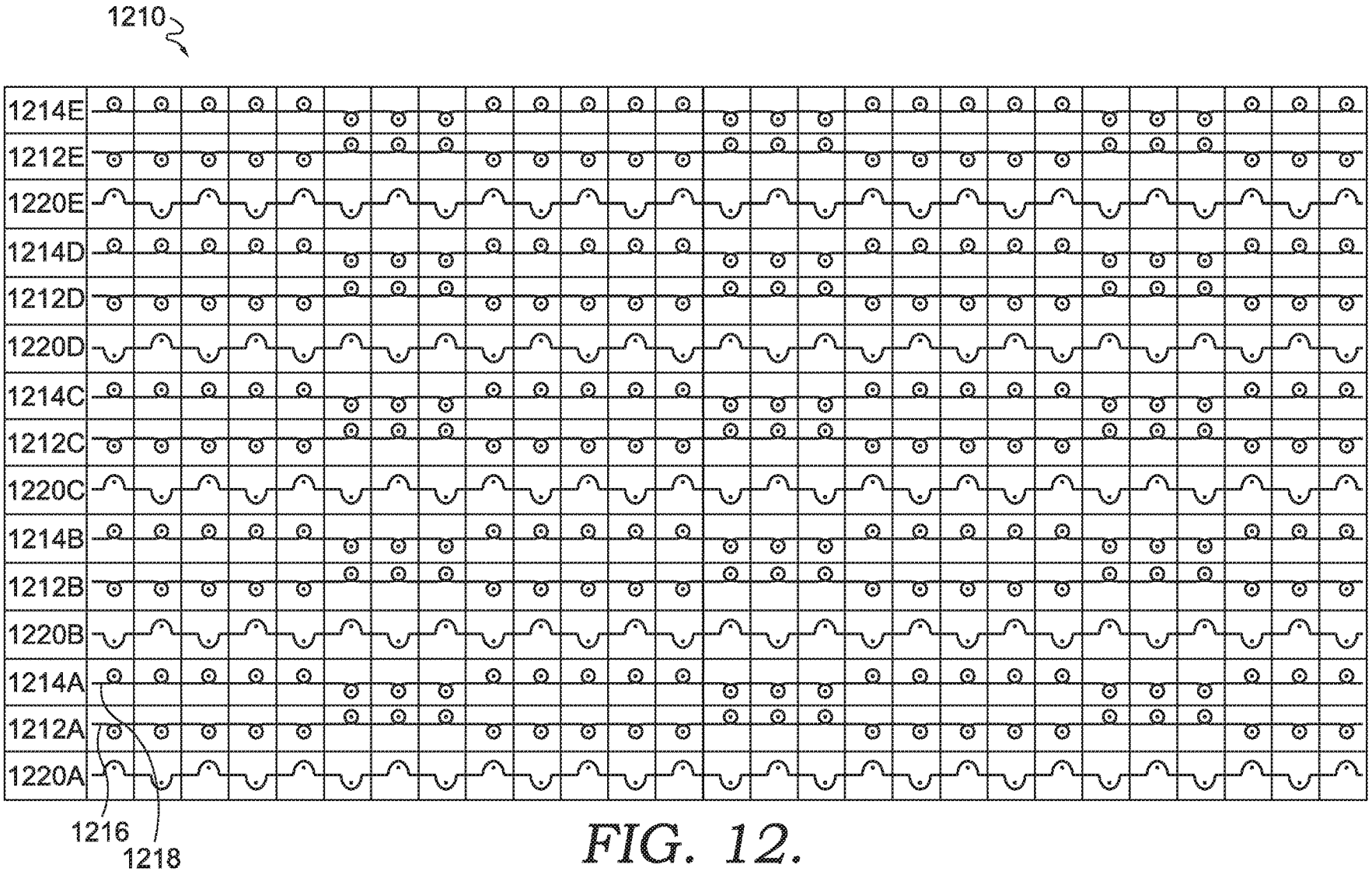
FIG. 12 depicts knit-program notations in accordance with an aspect of this disclosure.

To further illustrate how courses of interlocking tuck stitches might be constructed into a knit textile panel, another knit diagram 1210 is illustrated in FIG. 12. The knit diagram 1210 is similar to the knit diagram 710 of FIG. 7A in some respects. For example, the knit diagram 1210 depicts a series of first-yarn rows 1212A-1212E showing stitch types and location for a first yarn strand 1216 and a series of second-yarn rows 1214A-1214E showing stitch type and location for a second yarn strand 1218. In addition, similar to FIG. 7A, the first yarn strand 1216 and the second yarn strand 1218 construct similar interlocked courses with a repeating intra-course knit sequence having eight front stitches, eight back stitches, and a single interlocking cross over among the eight front and back stitches. In addition, the knit diagram 1210 further depicts a series of third-yarn rows 1220A-1220E that prescribe interlocking tuck stitches in each course that alternate from the front bed to the back bed and that are constructed at every other front stitch and every other back stitch. Furthermore, the knit diagram 1210 indicates that the consecutive courses of interlocking tuck stitches (e.g., 1220A and 1220B) are offset from one another. As such, the needles in course 1220A that are skipped and don't include a tuck stitch will include a tuck stitch in the immediately consecutive course 1220B.

The knit diagram 1210 of FIG. 12 is exemplary of one knit structure that includes an interlocking tuck binder. In other aspects of the present disclosure, each of the various knit structures depicted in FIGS. 8A-8D may also be supplemented to include offset courses of interlocking tuck stitches. Furthermore, each of the additional possible knit combinations described with respect to FIGS. 7A-8D may also include offset courses of interlocking tuck stitches, including intra-course knit sequences with at least four front stiches and back stitches and less than or equal to twelve front stitches and back stitches. In a further aspect, tubular-jacquard knit structures with an interlock tuck binder may include smaller or larger subsets of front and back stitches, as described in other parts of this disclosure.

In a further aspect, the third yarn strand that is used to construct the interlocking tuck stitches includes properties similar to the first yarn strand and the second yarn strand. For example, the third yarn strand includes a non-elastic yarn type (also sometimes referred to as a non-stretch yarn), which includes an amount of elasticity that provides a maximum stretch of less than 200% under load prior to returning to a non-stretched state when the load is removed. In a further aspect, the non-elastic yarn type of the first yarn strand and the second yarn strand provides a maximum stretch of less than 100%. Examples of non-elastic yarn types include nylon and polyester. In one aspect of the disclosure, the third yarn strand include two ends of nylon 2/78D/68 (i.e., 2 ply where each ply is 78 decitex with 68 filaments).

The interlock tuck binder adds various properties to a knit textile region having the tubular-jacquard knit structures described in this disclosure. For example, the interlock tuck binder retains the front-stitch courses and the back-stitch courses together to yield a flatter knit textile panel that is thrown or pushed wider. Furthermore, the binder helps to facilitate a more tightly knit textile panel. For example, in one aspect the stitch length of the tuck is in a range of about 2.6 mm to about 3.0 mm. The properties conveyed by the course(s) of interlocking tuck stitches are achieved by the smaller spacing of the tuck stitches as well as the yarn composition (e.g., non-stretch) and size. The course of interlocking tuck stitches differs from some other types of additional knit structures that might be added to a knit structure, such as a spacer knit structure, which often spaces the tuck stitches further apart, utilizes a wider needle-bed spacing, and integrates a larger yarn.

Previously described portions of this disclosure related to FIGS. 4-12 describe various tubular-jacquard knit structures that might construct the knit-textile regions 66 and 68 depicted in FIGS. 1-3. As previously described, these tubular-jacquard knit structures provide an amount of elongation to the knit-textile regions 66 and 68, based at least in part on the density of interlocking cross overs, the yarn composition, the yarn size, the stitch length, or any combination thereof. Accordingly, in an aspect of the disclosure, the amount of elongation translates to a modulus of elasticity that provides an amount of support and compression to an underlying tissue (e.g., breast tissue). As such, a size of the knit-textile regions 66 and 68 may be configured to include a portion of, or all of, the breast-covering portions 30 and 32, and the size may be determine in various manners, some of which may relate to a size of the upper-torso garment, the breast-covering portions, or a combination thereof. A modulus of elasticity may be determined in various manners, and in one aspect, a testing methodology specified by ASTM D 4964-96 may be used.

An aspect of the present disclosure includes upper-torso garments having sizes and dimensions. For example, the upper-torso garment might be a bra having a chest band with a size equal to or greater than 30 inches and equal to or less than 42 inches and a cup size in a range of A to E. In addition, the bra might have a sizing of small, medium, large, x-large, etc. The breast-covering portions 30 and 32 may also have various sizes. For example, at a bottom perimeter edge of the breast-covering portions 30 and 32, where the bottom perimeter edge meets the chest band 50, the bottom perimeter edge of one of the breast-covering portions 30 and 32 might have a length in a range of about 3" to about 5" inches. In another aspect, the bottom perimeter edge of each of the breast-covering portions might have a number of stitches in a range of about 90 stitches to about 120 stitches. For example, the breast-covering portions 30 and 32 in FIGS. 1-3 each include about 104 stiches along the bottom perimeter edge that meets the chest band 50. In addition, the medial perimeter edge of each of the breast-covering portions 30 and 32 that interface with the center bridge 34 might include a length in a range of about 3.5" inches to about 5.5" inches. And in another aspect, the medial perimeter edge of each of the breast-covering portions 30 and 32 might include a number of courses in a range of about 150 to about 240.

Having described some exemplary sizes and dimensions of an upper-torso garment, another aspect of the disclosure relates to the size of the knit-textile regions 66 and 68 that include a tubular-knit textile and that are positioned in the breast-covering regions 30 and 32. This relative sizing between the knit-textile panels 66 and 68 and the breast-covering portion 30 and 32 may, at least in part, determine the extent to which the elongation properties provided by the knit-textile panel are transferred to the breast-covering portions 30 and 32.

A size of a knit-textile region 66 and 68 may be determined by various metrics. For example, the knit-textile regions 66 and 68 may include a polygonal shape having measured sides, and in one aspect the knit-textile regions 66 and 68 are at least 1" by 1" square. And in another aspect, the knit-textile panels 66 and 68 include a size that corresponds with at least some of the dimensions of the breast-covering regions 30 and 32, such that a base perimeter edge abutting the chest band is in a range of about 3" to about 5", and a medial edge abutting the medial region is in a range of about 3.5" to about 5.5". These dimensions are exemplary of one aspect of the present invention, and in other aspects the dimensions of the knit textile region may be smaller than the range listed. These dimensions of the knit textile region may also be larger than the listed range.

In a further aspect of the disclosure, a size of the knit-textile regions 66 and 68 might be based on a number of courses and stitches. For instance, in one aspect, the knit-textile regions 66 and 68 include a quantity of interlocked courses in a range of about 40 courses to about 120 courses, each interlocked course including a front-stitch course and a back-stitch course. In a further aspect, such as when the knit-textile panel includes a size that corresponds with the medial edge of the breast-covering portion 30 and 32 each knit-textile region 66 and 68 includes a quantity of courses in a range of about 150 courses to about 240 courses. In addition, each of these courses in the quantity includes a respective intra-knit sequence that repeats along the interlocked course. Based on the size of the intra-course knit sequence (e.g., between four and twelve stitches) and based on the number of times the intra-course knit sequence repeats, another dimension of the knit textile panel can be determined based on the total number of stitches in a respective course. For example, as previously indicated, an intra-course knit sequence might have a quantity of stitches equal to or greater than four and less than or equal to twelve, and the sequence might repeat between five and ten times. Using these exemplary numbers, a width of a knit textile region might be between 20 stitches and 120 stitches. And in a further aspect, such as when the knit-textile panel includes a size that corresponds with the bottom perimeter edge of the breast-covering portion 30 and 32 each knit-textile region 66 and 68 may include a quantity of stitches in a range of about 80 to about 120.

As described in other parts of this disclosure, a number of interlocking cross overs in a course or in a knit textile panel can be increased or decreased to change the elongation properties (e.g., modulus of elasticity). As such, an aspect of the present invention includes an upper-torso garment that includes a first knit zone having a first modulus of elasticity and a second knit zone having a second modulus of elasticity, which is greater than the first modulus of elasticity. Furthermore, the first knit zone is constructed of a first tubular-jacquard knit structure, and the second knit zone is constructed of a second tubular-jacquard knit structure. The first and second tubular-jacquard knit structures both include a plurality of front-stitch courses that are intermittently interlocked with a plurality of back-stitch courses. However, the density of the interlocking cross overs in the second tubular-jacquard knit structure is lower than the density of the interlocking cross overs in the first tubular-jacquard knit structure, and the lower density increases the modulus of elasticity by lowering the elongation provided by the fewer number of interlocking cross overs. This aspect of the present disclosure allows different regions of the upper-torso garment to be constructed of the same yarn type, same yarn size, same stitch structures, and different zonal properties based on the density of the interlocking cross overs.

Figure 13:
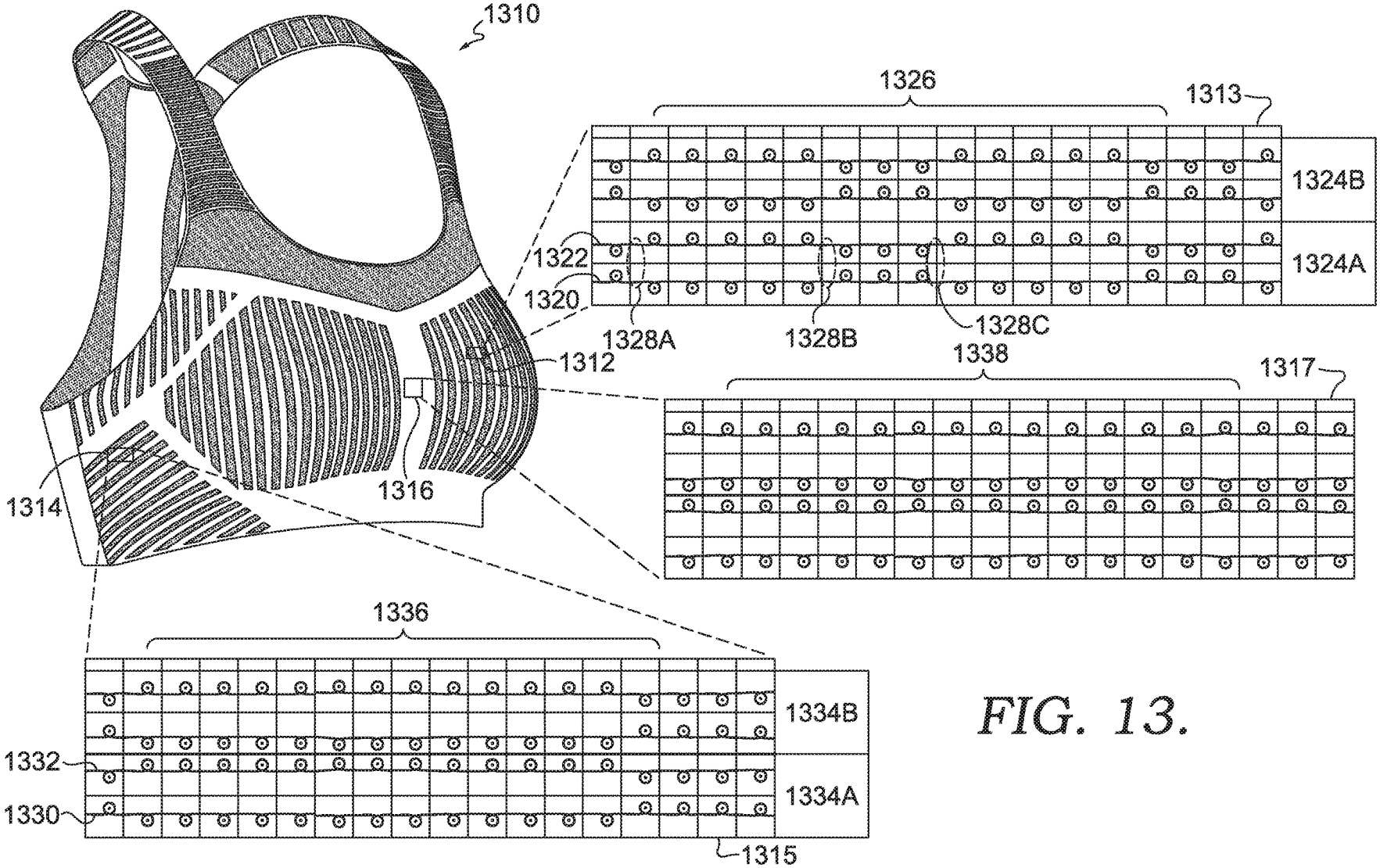
FIG. 13 depicts an upper-torso garment having multiple tubular-jacquard knit zones.

Referring now to FIG. 13, the upper-torso garment 1310 includes a first knit zone 1312 having a first tubular-jacquard knit structure in the breast-covering portion, a second knit zone 1314 having a second tubular-jacquard knit structure in the wing portion, and a third knit zone 1316 having a third tubular-jacquard knit structure in the center bridge. The tubular-jacquard knit structures are represented by respective knit diagrams 1313, 1315, and 1317, and it is understood that the knit diagrams 1313, 1315, and 1317, when executed, would construct a respective tubular-jacquard knit structure.

As indicated by the knit diagram 1313, the first tubular jacquard knit structure includes a first plurality of front-stitch courses and a first plurality of back-stitch courses, the first plurality of front-stitch courses and the first plurality of back-stitch courses being constructed of a first yarn strand 1320 and a second yarn strand 1322. Each front-stitch course of the first plurality of front-stitch courses intermittently interlocks with a back-stitch course of the first plurality of back-stitch courses to form a plurality of first interlocked courses 1324A and 1324B. Each first interlocked course 1324A and 1324B of the plurality of first interlocked courses includes a first set of consecutive needle positions 1326 having a quantity of needles (e.g., 14). In addition, each first interlocked course 1324A and 1324B includes three interlocking cross overs 1328A-1328C of the first yarn strand 1320 and the second yarn strand 1322 positioned among the first set of consecutive needle positions 1326. The first set of consecutive needle positions 1326 are consistent throughout the plurality of first interlocked courses 1324A and 1324B.

With continued reference to FIG. 13, the second tubular-jacquard knit structure shown by the knit diagram 1315 includes a second plurality of front-stitch courses and a second plurality of back-stitch courses, the second plurality of front-stitch courses and the second plurality of back-stitch courses being constructed of a third yarn strand 1330 and a fourth yarn strand 1332. Each front-stitch course of the second plurality of front-stitch courses intermittently interlocks with a back-stitch courses of the second plurality of back-stitch courses to form a plurality of second interlocked courses 1334A and 1334B, and each second interlocked course 1334A and 1334B includes a second set of consecutive needle positions 1336 having the same quantity of needles as identified in the knit diagram 1313 (e.g., 14). The second interlocked courses includes fewer than three interlocking cross overs of the third yarn strand and the fourth yarn strand positioned among the second set of consecutive needle positions 1336. As such, as compared to the first tubular-jacquard knit structure, the second tubular-jacquard knit structure would exhibit both less elongation attributable to the interlocking cross overs and a higher modulus of elasticity. Accordingly, as between the two knit zones 1312 and 1314, the same yarns can be carried throughout both zones, and different elongation properties can be imparted by constructing different densities of interlocking cross overs between two zones.

The third knit diagram 1317 correlates with a third tubular-jacquard knit structure, and the interlocking cross overs that link the front-stitch courses to the back-stitch courses are spaced further apart than the number of needle positions depicted in the knit diagram 1317. For example, the interlocking cross overs that connect front-stitch courses and back stitch courses in the third tubular-jacquard knit structure may be positioned closer to, or along, the transition from the center bridge to the breast-covering portion, which is outside of the portion depicted by the third knit diagram 1317. As such, the front-stitch courses and the back-stitch courses form interlocked courses, but within the quantity of needle positions 1338, the third tubular-jacquard knit structure does not include any interlocking cross overs. Compared to the first tubular-jacquard knit structure and the second tubular-jacquard knit structure, the third tubular-jacquard knit structure might have the lowest amount of elongation attributable to the interlocking cross overs and the highest modulus of elasticity.

The knit diagrams in FIG. 13 are merely exemplary of one aspect of the present disclosure. In other aspects, the densities of interlocking cross overs in each of the knit zones may be smaller or larger, but the knit zones may still include different densities resulting in zonal differences in elongation properties. In addition, the intra-course knit sequences depicted in the diagrams may alternatively include any of the intra-course knit sequences depicted in FIGS. 8A-8D, the offset interlocking tuck binders described with respect to FIGS. 9-12, or may apply any of the organization principles described with respect thereto (e.g., various sized stitch subsets). For example, an interlocking cross over within an intra-course knit sequence may divide front stitches and back stitches into subsets with an equal number of stiches or with an unequal number of stitches. In addition, the interlocking cross overs in one course may either be aligned (by needle position) with interlocking cross overs in adjacent courses, or the interlocking cross overs in one course may be offset (by needle position) with interlocking cross overs in adjacent courses. Furthermore, the courses of offset interlocking tuck stitches may also be constructed into the first, second, and third tubular-jacquard knit structures, and the structures will still include zonal differences in modulus of elasticity based on differences in the respective density of interlocking cross overs.

Furthermore, the size of the knit diagrams in FIG. 13 is provided for illustrative purposes, including two interlocking courses with 18 needle positions. And in other aspects, each of the knit zones may be larger (i.e., more than two courses), such that the knit zones provide larger knit textile portions having varied elongation properties based on the tubular-jacquard knit structure. For example, each knit zone may include a number of knit courses in a range of at least forty interlocked courses and less than 120 interlocked courses. And in other aspects, a knit zone may include more than 120 interlocked courses.

In addition, other regions of the upper-torso garment may also include zones with different tubular-jacquard knit structures resulting in different modulus of elasticity. For example, the underarm zones, upper-chest region, encapsulating regions, and straps may also include a knit zone having a tubular-jacquard knit structure. Accordingly, in one aspect of the present disclosure, various portions of the upper-torso garment, including the breast-covering regions, the center bridge, the encapsulation regions, the upper-chest region, the underarm portions, and the wing portions, are each constructed of a tubular-jacquard knit structure having an interlocking tuck binder, and in each portion elongation properties may be adjusted by increasing or decreasing the number of interlocking cross overs.

Figure 14:
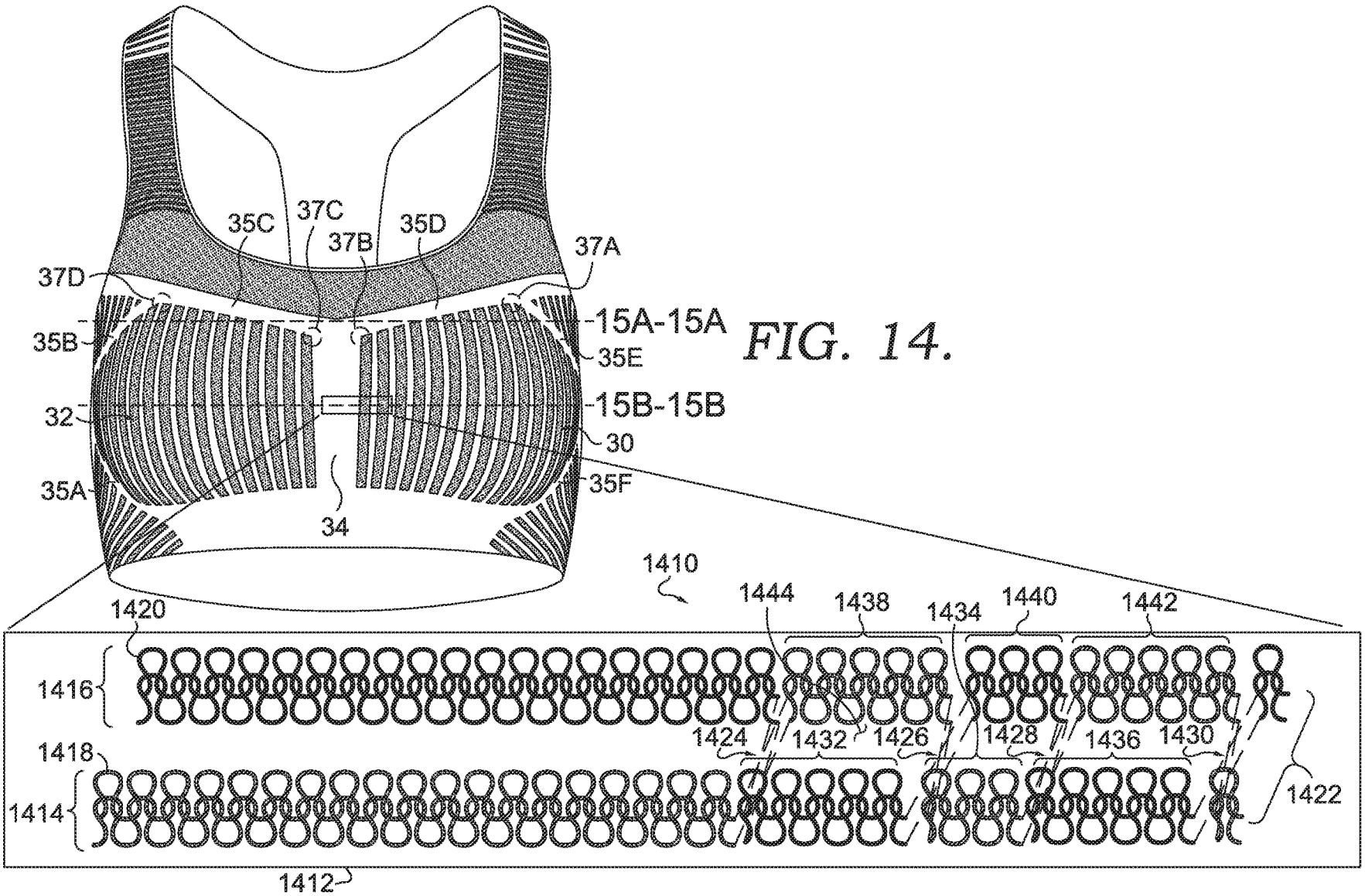
FIG. 14 depicts an upper-torso garment having a tubular-jacquard knit structure in accordance with an aspect of this disclosure.
Figure 15:
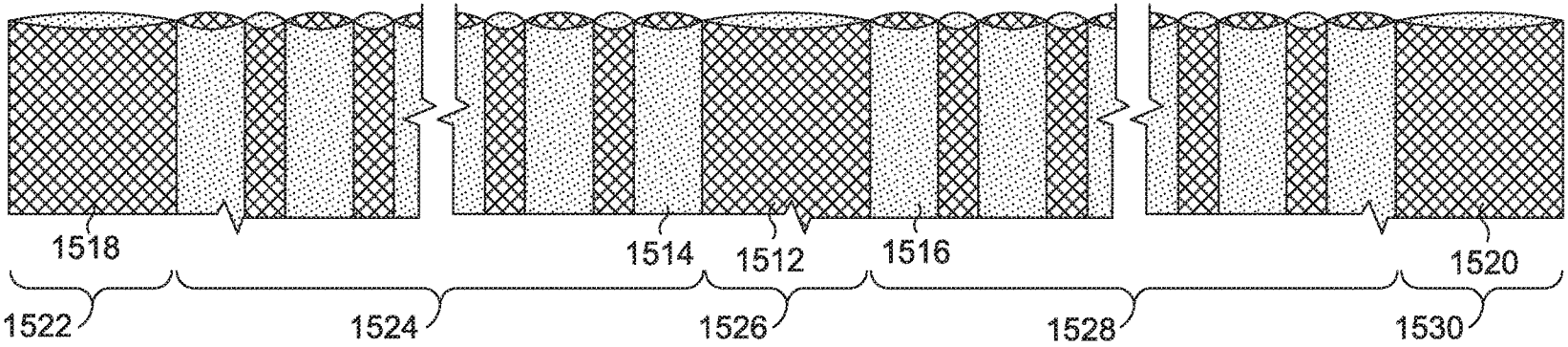
FIG. 15 depicts a perspective view of a cross-section taken along reference line 15A-15A or 15B-15B in FIG. 14.
Figure 16:
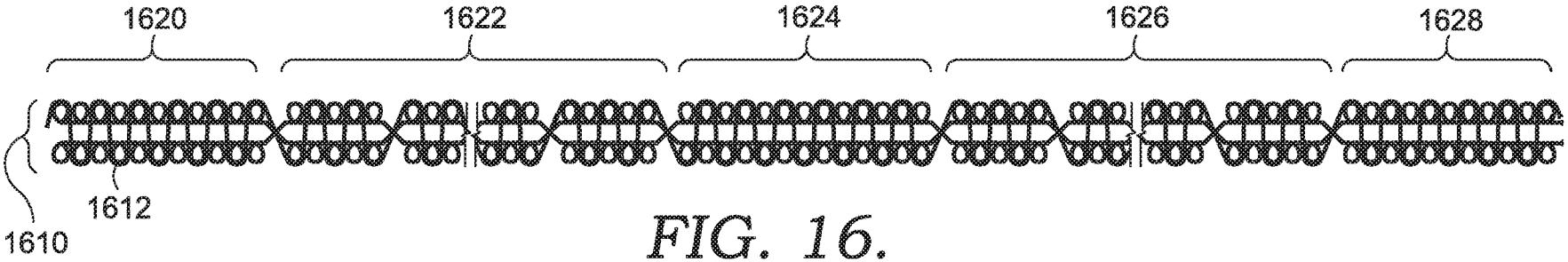
FIG. 16 depicts a schematic of the cross-section of FIG. 15.

Referring now to FIGS. 14-16, an aspect of the disclosure is directed to positioning tubular-jacquard knit textile regions having a lower density of interlocking cross overs around at least a portion of the breast-covering portions 30 and 32 in order to provide one or more encapsulating regions 34, 35A, 35B, 35C, 35D, 35E, and 35F. That is, the encapsulating regions include a higher modulus of elasticity, relative to the breast-covering portions 30 and 32, based on the encapsulating regions exhibiting a lower degree of elongation from a lower density of interlocking cross overs.

As a further illustrative, FIG. 14 includes a magnified view 1410 showing a tubular-jacquard knit structure 1412 positioned in the breast-covering portion. The tubular-jacquard knit region includes a plurality of front-stitch courses 1414 consecutively interlooped with one another. The tubular-jacquard knit region also includes a plurality of back-stitch courses 1416 consecutively interlooped with one another. The plurality of front-stitch courses and the plurality of back-stitch courses are constructed of a first yarn strand 1418 and a second yarn strand 1420. Furthermore, each front-stitch course of the plurality of front-stitch courses intermittently interlocks with a back-stitch course of the plurality of back-stitch courses to form a plurality of interlocked courses (e.g., 1422).

Each interlocked course (e.g., 1422) of the plurality of interlocked courses includes a plurality of interlocking cross overs. For example, the interlocked course 1422 includes four interlocking cross overs 1424, 1426, 1428, and 1430 (depicted as broken lines to avoid overcrowding in the figure). Each interlocking cross over includes the first yarn strand and the second yarn strand crossing over one another to change positions between a respective front-stitch course and a respective back-stitch course. In each interlocked course, the plurality of interlocking cross overs divide the respective front-stitch course into a plurality of front-stitch subsets and the respective back-stitch course into a plurality of back-stitch subsets, such as 1432, 1434, 1436, 1438, 1440, 1442.

As described with respect to FIG. 6A, a front-stitch subset (e.g., 1432), a back-stitch subset (e.g., 1438), and a pair of adjacent interlocking cross overs (e.g., 1424 and 1426) at least partially partition off a space (e.g., 1444) between a front-stitch course and the back-stitch course, such that a knit tubular structure is formed. FIG. 15 represents a perspective view of a cross section taken at the reference line 15A-15A or the reference line 15B-15B in FIG. 14, and for illustrative purposes, the cross section of FIG. 15 has been depicted relatively straight, even though the front surface of the breast-covering portion in FIG. 14 includes various curves. In addition, for illustrative purposes, the knit structure of FIG. 15 is shown without explicitly depicting an interlock tuck binder, but in other aspects, the knit structure in FIG. 15 may also include an interlock tuck binder.

FIG. 15 provides an illustrative schematic showing this tubular nature in more detail. That is, each interlocked course includes a plurality of side-by-side knit tubular structures, and when a plurality of interlocked courses are interloopedly connected, the more elongated knit tubular structures 1512, 1514, 1516, 1518, and 1520 of FIG. 15 are formed and arranged side-by-side, across the tubular-jacquard knit region. While all of the knit tubular structures are comprised of a respective subset of front stitches and back stitches, the quantity of stitches in those subsets affects the width of the knit tubular structure. For example, the subset of front stitches that makes up the knit tubular structure 1512 has more stitches than the subset of front stitches that makes up the knit tubular structure 1514, as evidenced by the wider depiction of the knit tubular structure 1512.

In FIG. 15, the tubular-jacquard knit region is divided into a first knit zone 1522, a second knit zone 1524, a third knit zone 1526, a fourth knit zone 1528, and a fifth knit zone 1530, and each knit zone includes a respective subset of knit tubular structures. In accordance with an aspect of this disclosure, the width of the knit tubular structures in each knit zone affects elongation properties of the knit zone. Furthermore, the width of the knit tubular structure is determined by the spacing of the interlocking cross overs and resulting quantity of stitches in the front-stitch subset and back-stitch subset.

In a further aspect, the first knit zone 1522 constructs at least part of an the encapsulating region(s) 35A and/or 35B, the second knit 1524 constructs at least part of the breast-covering portion 32, the third knit zone 1526 constructs at least part of the center bridge 34, the fourth knit zone 1528 constructs at least part of the other breast-covering portion 30, and the fifth knit zone 1530 constructs at least part of another encapsulating region(s) 35E and/or 35F. As such, the second and fourth knit zones may include subsets of front and back stitches that are smaller than the first, third, and fifth knit zones. And in one aspect of this disclosure, the knit tubular structures in the second and fourth zones includes two or more knit tubular structures, each having at least two and fewer than seven front stitches and at least two and fewer than seven back stitches. Each of the first, third, and fifth zones includes a single knit tubular structure having at least seven front stitches and at least seven back stitches.

The number of knit tubular structures in the second and fourth zones might vary depending on a location of the knit zone, and the second and forth zones are depicted with break lines to illustratively convey that the repeating pattern may have various numbers of knit tubular structures. For example, if the knit zone is aligned with the cross-section reference line 15A-15A, then the number of knit tubular structures in the second and fourth zones would be less than if the knit zone is aligned with the cross-section reference line 15B-15B. More specifically, the striping in FIG. 14 suggests that at line 15A-15A, the second and fourth zones might each include around 16-18 knit tubular structures, and that at the line 15B-15B the second and fourth zones might each include around 35 or 36 knit tubular structures. Furthermore, the number of front and back stitches in the third knit zone would increase along line 15A-15A to construct a wider knit tubular structure that would span the two breast-covering portions 30 and 32.

FIGS. 14 and 15 depict the knit tubular structures as being aligned with needle positions and extending substantially orthogonal to the courses. And in other aspects, the interlocking cross overs may be offset from course to course, such that a diagonal, zigzag, or other shape of knit tubular structure is formed. For example, the encapsulating bands 35A-35F extend at an angle relative to the direction of the courses to form a polygonal perimeter around the breast-covering portions 30 and 32. In one aspect of the disclosure, the angled junctions 37A, 37B, 37C, and 37D help to impede movement of breast tissue when the upper-torso garment is worn. For example, as compared with a more curved perimeter encapsulating region, the angled junctions 37A, 37B, 37C, and 37D may impede rotational or circular movement of the breast tissue.

Furthermore, the intra-course knit sequences suggested in FIGS. 14 and 15 are merely exemplary, and in other aspects, the knit tubular structures may be constructed using any of the intra-course knit sequences depicted in FIGS. 8A-8D, as well as the offset interlocking tuck binders described with respect to FIGS. 9-12. For example, an interlocking cross over within an intra-course knit sequence may divide front stitches and back stitches into subsets with an equal number of stiches or with an unequal number of stitches. Furthermore, courses of offset interlock tuck stitches may also be constructed into the front and back courses that form the elongated knit tubular structures, and the structures will still include zonal differences in elongation properties based on differences in the respective tube widths. For example, FIG. 16 provides a schematic of an interlocked course 1610, having similar break lines and zones 1622, 1624, 1626, 1628, and 1620 to that depicted in FIG. 15. FIG. 16 further illustrates a third yarn strand 1612 that forms a course of interlock tuck stitches together with the interlocked course 1610. As described in other portions of this disclosure, adjacent courses may also include a course of interlock tuck stitches that are offset from the course formed by the third yarn strand 1612.

An upper-torso garment having one or more of the aspects described in this disclosure may be constructed in various manners. For instance, a flat-bed knitting machine may be used, having a front needle bed and a back needle bed, such as a commercially available V-bed knitting machine. Knitting machines having various bed gauges may be used, and in one aspect, an 18 gauge bed is used to construct an upper-torso garment. Furthermore, various size needles may be used, such as 14 gauge, 16, gauge, 18 gauge, etc., and in one aspect, 16 gauge needles are used on an 18 gauge needle bed.

The entire upper-torso garment may be knit as a single integrated piece, which is then coupled together at particular locations to create a left side, right side, anterior portion, and posterior portion. In addition, certain parts of the upper-torso garment may be knit separately from one another and then coupled to form the upper-torso garment. In one aspect, the anterior portion with straps is constructed separately from the posterior portion and the two pieces are then coupled to form the upper-torso garment. For example, at least part of the anterior portion may be constructed with all non-elastic yarns, whereas elastic yarns may be knit into the posterior portion. The anterior portion may then be coupled to the posterior portion. These manufacturing aspects are merely exemplary, and various other techniques may also be utilized.

Having described various aspects illustrated in FIGS. 1-16, as well as alternative aspects, some additional aspects will now be described that draw on one or more of the illustrated, or alternative aspects. For example, in one aspect an upper-torso garment (e.g., bra, camisole, tank, singlet, base-layer shirt, racing unitard, etc.) for a male or female includes a chest-covering region constructed of a tubular-jacquard knit structure. The tubular-jacquard knit structure includes interlocking cross overs that at least partially contribute to an elongation property, which allows the chest-covering region (e.g., breast-covering region) to stretch and recover regardless of whether the chest-covering region is constructed of elastic or non-elastic yarns. In a further aspect, the density of interlocking cross overs can be varied in different zones of the upper-torso garment to tune the elongation property and provide zones with different modulus' of elasticity. As such, an upper-torso garment can include the same yarns in different zones with different elongation properties, the different zones having different quantities of interlocking cross overs in a given area. In a further aspect, breast-covering portions can be constructed together with encapsulation regions, zones, bands, and the like across the anterior portion of the upper-torso garment. For example, the breast-covering portions might include front-stitch and back-stitch subsets An additional aspect of the present disclosure is directed to an upper-torso garment having a first knit zone with a first modulus of elasticity and a second knit zone with a second modulus of elasticity, which is greater than the first modulus of elasticity. The first knit zone includes a first tubular-jacquard knit structure and the second knit zone includes a second tubular-jacquard knit structure. The first tubular jacquard knit structure includes a first plurality of front-stitch courses and a first plurality of back-stitch courses, the first plurality of front-stitch courses and the first plurality of back-stitch courses being constructed of a first yarn strand and a second yarn strand. Each front-stitch course of the first plurality of front-stitch courses intermittently interlocks with a back-stitch course of the first plurality of back-stitch courses to form a plurality of first interlocked courses. In addition, each first interlocked course of the plurality of first interlocked courses includes a first set of consecutive needle positions having a quantity of needles. Further, each first interlocked course includes three interlocking cross overs of the first yarn strand and the second yarn strand positioned among the first set of consecutive needle positions. The first set of consecutive needle positions is consistent throughout the plurality of first interlocked courses. The second tubular jacquard knit structure includes a second plurality of front-stitch courses and a second plurality of back-stitch courses, the second plurality of front-stitch courses and the second plurality of back-stitch courses being constructed of a third yarn strand and a fourth yarn strand. Each front-stitch course of the second plurality of front-stitch courses intermittently interlocks with a back-stitch course of the second plurality of back-stitch courses to form a plurality of second interlocked courses. Each second interlocked course of the plurality of second interlocked courses includes a second set of consecutive needle positions having the quantity of needles (i.e., same quantity as the first set of consecutive needle positions) and includes fewer than three interlocking cross overs of the third yarn strand and the fourth yarn strand positioned among the second set of consecutive needle positions.

Another aspect of this disclosure includes an upper-torso garment having a first knit zone and a second knit zone. The first knit zone includes a first tubular-jacquard knit structure having a first modulus of elasticity, and the second knit zone includes a second tubular-jacquard knit structure having a second modulus of elasticity, which is greater than the first modulus of elasticity. The first tubular-jacquard knit structure includes a first set of forty front-stitch courses, a first set of forty back-stitch courses, and a first set of consecutively arranged needle positions that is consistent among the first set of forty front-stitch and back-stitch courses. The first set of consecutively arranged needle positions includes a quantity of needle positions. In addition, the first set of forty front-stitch and back-stitch courses includes a first quantity of stitches based on the quantity of needle positions in the first set of consecutively arranged needle positions. The second tubular-jacquard knit structure includes a second set of forty front-stitch courses, a second set of forty back-stitch courses, and a second set of consecutively arranged needle positions. The second set of consecutively arranged needle positions is consistent among the second set of forty front-stitch and back-stitch courses and includes the quantity of needle positions (i.e., the same quantity as in the first tubular-jacquard knit structure). The second set of forty front-stitch and back-stitch courses and the second set of consecutively arranged needle positions include a second quantity of stitches. Each front-stitch course of the first set of forty front-stitch courses and each back-stitch course of the first set of forty back-stitch courses includes a first yarn strand and a second yarn strand. The first set of forty front-stitch courses is intermittently interlocked with the first set of forty back-stitch courses by a first quantity of interlocking cross overs of the first yarn strand and the second yarn strand. The first quantity of interlocking cross overs is dispersed intermittently among the first set of forty front-stitch courses and the first set of forty back-stitch courses and is positioned among the first set of consecutively arranged needle positions. Furthermore, a first ratio of the first quantity of interlocking cross overs to the first quantity of stitches is in a range of about 1:4 to about 1:13. In addition, each front-stitch course of the second set of forty front-stitch courses and each back-stitch course of the second set of forty back-stitch courses includes a third yarn strand and a fourth yarn strand. The second set of forty front-stitch courses is intermittently interlocked with the second set of forty back-stitch courses by a second quantity of interlocking cross overs of the third yarn strand and the fourth yarn strand. Further, the second quantity of interlocking cross overs is dispersed intermittently among the second set of forty front-stitch courses and the second set of forty back-stitch courses and is positioned among the second set of consecutively arranged needle positions. A second ratio of the second quantity of interlocking cross overs to the second quantity of stitches is less than the first ratio.

An additional aspect of the present disclosure is directed to an upper-torso garment having a first knit zone with a first modulus of elasticity and a second knit zone with a second modulus of elasticity, which is greater than the first modulus of elasticity. The first knit zone includes a first tubular-jacquard knit structure and the second knit zone includes a second tubular-jacquard knit structure. The first tubular jacquard knit structure includes a first plurality of front-stitch courses and a first plurality of back-stitch courses, the first plurality of front-stitch courses and the first plurality of back-stitch courses being constructed of a first yarn strand and a second yarn strand. Each front-stitch course of the first plurality of front-stitch courses intermittently interlocks with a back-stitch course of the first plurality of back-stitch courses to form a plurality of first interlocked courses. Each first interlocked course also includes a third yarn strand forming a course of interlock tuck stitches that binds a respective front-stitch course to a respective back-stitch course by interlooping with every other front stitch and every other back stitch. In addition, each first interlocked course of the plurality of first interlocked courses includes a first set of consecutive needle positions having a quantity of needles. Further, each first interlocked course includes three interlocking cross overs of the first yarn strand and the second yarn strand positioned among the first set of consecutive needle positions. The first set of consecutive needle positions is consistent throughout the plurality of first interlocked courses. The second tubular jacquard knit structure includes a second plurality of front-stitch courses and a second plurality of back-stitch courses, the second plurality of front-stitch courses and the second plurality of back-stitch courses being constructed of a fourth yarn strand and a fifth yarn strand. Each front-stitch course of the second plurality of front-stitch courses intermittently interlocks with a back-stitch course of the second plurality of back-stitch courses to form a plurality of second interlocked courses. Each second interlocked course also includes a sixth yarn strand forming a course of interlock tuck stitches that binds a respective front-stitch course to a respective back-stitch course by interlooping with every other front stitch and every other back stitch. Each second interlocked course of the plurality of second interlocked courses includes a second set of consecutive needle positions having the quantity of needles (i.e., same quantity as the first set of consecutive needle positions) and includes fewer than three interlocking cross overs of the third yarn strand and the fourth yarn strand positioned among the second set of consecutive needle positions.

From the foregoing, it will be seen that this subject matter is adapted to attain ends and objects hereinabove set forth together with other advantages, which are obvious and which are inherent to the structure. It will be understood that certain features and subcombinations are of utility and may be employed without reference to other features and subcombinations. This is contemplated by and is within the scope of the claims. Since many possible variations and alternatives may be made of the subject matter without departing from the scope thereof, it is to be understood that all matter herein set forth or shown in the accompanying drawings is to be interpreted as illustrative and not in a limiting sense.

What is claimed is:

1. An upper-torso garment comprising:

a breast-covering portion including a first tubular-jacquard knit zone; and a wing portion including a wing tubular-jacquard knit zone;

the first tubular-jacquard knit zone comprising a first plurality of front-stitch courses and a first plurality of back-stitch courses constructed of a first non-stretch yarn strand and a second non-stretch yarn strand;

wherein each front-stitch course of the first plurality of front-stitch courses intermittently interlocks with a back-stitch course of the first plurality of back-stitch courses to form a plurality of first interlocked courses; and wherein each first interlocked course includes a first set of consecutive stitch locations having a quantity of stitches and includes three interlocking cross overs of the first non-stretch yarn strand and the second non-stretch yarn strand positioned among the first set of consecutive stitch locations, the three interlocking cross overs within the first set of consecutive stitch locations contributing to a first modulus of elasticity of the first tubular-jacquard knit zone; and the wing tubular-jacquard knit zone comprising a second plurality of front-stitch courses and a second plurality of back-stitch courses constructed of a third non-stretch yarn strand and a fourth non-stretch yarn strand;

wherein each front-stitch course of the second plurality of front-stitch courses intermittently interlocks with a back-stitch course of the second plurality of back-stitch courses to form a plurality of second interlocked courses; and wherein each second interlocked course includes a second set of consecutive stitch locations having the quantity of stitches and includes fewer than three interlocking cross overs of the third non-stretch yarn strand and the fourth non-stretch yarn strand positioned among the second set of consecutive stitch locations, the fewer than three interlocking cross overs within the second set of consecutive stitch locations contributing to a second modulus of elasticity of the wing tubular-jacquard knit zone that is greater than the first modulus of elasticity.

2. The upper-torso garment of claim 1, wherein each of the first non-stretch yarn strand, the second non-stretch yarn strand, the third non-stretch yarn strand, and the fourth non-stretch yarn strand includes an amount of elasticity providing a maximum stretch of less than 200% prior to returning to a non-stretched state.

3. The upper-torso garment of claim 1, wherein the first tubular-jacquard knit zone and the wing tubular-jacquard knit zone do not include any yarn strands including an amount of elasticity providing a maximum stretch of more than 200% prior to returning to a non-stretched state.

4. The upper-torso garment of claim 1, wherein the first non-stretch yarn strand, the second non-stretch yarn strand, the third non-stretch yarn strand, and the fourth non-stretch yarn strand each includes a same yarn type having a same yarn composition and a same yarn size.

5. The upper-torso garment of claim 1, wherein the breast-covering portion comprises a first breast-covering portion and a second breast-covering portion;

wherein the upper-torso garment further comprises a center bridge portion comprising a center bridge tubular-jacquard knit zone positioned between the first breast-covering portion and the second breast-covering portion.

6. The upper-torso garment of claim 5, wherein the center bridge tubular-jacquard knit zone comprises a third plurality of front-stitch courses and a third plurality of back-stitch courses constructed of a fifth non-stretch yarn strand and a sixth non-stretch yarn strand.

7. The upper-torso garment of claim 1, further comprising an encapsulation region comprising an encapsulation tubular-jacquard knit zone that forms a perimeter around at least part of the breast-covering portion of the first tubular-jacquard knit zone.

8. The upper-torso garment of claim 7, wherein the encapsulation tubular-jacquard knit zone comprise a first subset of knit tubular structures, a second subset of knit tubular structures, a third subset of knit tubular structures, and a fourth subset of knit tubular structures, wherein each subset of knit tubular structures extends orthogonal to a course direction.

9. An upper-torso garment comprising:

a breast-covering portion including a first tubular-jacquard knit zone; and a wing portion including a wing tubular-jacquard knit zone;

the first tubular-jacquard knit zone comprising a first plurality of front-stitch courses and a first plurality of back-stitch courses constructed of a first non-stretch yarn strand and a second non-stretch yarn strand;

wherein each front-stitch course of the first plurality of front-stitch courses intermittently interlocks with a back-stitch course of the first plurality of back-stitch courses to form a plurality of first interlocked courses; and wherein each first interlocked course includes a first set of consecutive stitch locations having a quantity of stitches and includes three interlocking cross overs of the first non-stretch yarn strand and the second non-stretch yarn strand positioned among the first set of consecutive stitch locations, the three interlocking cross overs within the first set of consecutive stitch locations contributing to a first modulus of elasticity of the first tubular-jacquard knit zone; and the wing tubular-jacquard knit zone comprising a second plurality of front-stitch courses and a second plurality of back-stitch courses constructed of a third non-stretch yarn strand and a fourth non-stretch yarn strand;

wherein each front-stitch course of the second plurality of front-stitch courses intermittently interlocks with a back-stitch course of the second plurality of back-stitch courses to form a plurality of second interlocked courses; and wherein each second interlocked course includes a second set of consecutive stitch locations having the quantity of stitches and includes fewer than three interlocking cross overs of the third non-stretch yarn strand and the fourth non-stretch yarn strand positioned among the second set of consecutive stitch locations, the fewer than three interlocking cross overs within the second set of consecutive stitch locations contributing to a second modulus of elasticity of the wing tubular-jacquard knit zone that is greater than the first modulus of elasticity, wherein the first tubular-jacquard knit zone and the wing tubular-jacquard knit zone do not include any yarn strands with an amount of elasticity providing a maximum stretch of more than 200% prior to returning to a non-stretched state.

10. The upper-torso garment of claim 9, wherein the first non-stretch yarn strand, the second non-stretch yarn strand, the third non-stretch yarn strand, and the fourth non-stretch yarn strand each includes a same yarn type having a same yarn composition and a same yarn size.

11. The upper-torso garment of claim 9 further comprising an encapsulation region comprising an encapsulation tubular-jacquard knit zone that forms a perimeter around at least part of the breast-covering portion of the first tubular-jacquard knit zone.

12. The upper-torso garment of claim 11, wherein the encapsulation tubular-jacquard knit zone comprises a first subset of knit tubular structures, a second subset of knit tubular structures, a third subset of knit tubular structures, and a fourth subset of knit tubular structures, wherein each subset of knit tubular structures extends orthogonal to a course direction.

13. The upper-torso garment of claim 12, wherein the encapsulation tubular-jacquard knit zone does not include any yarn strands with an amount of elasticity providing a maximum stretch of more than 200% prior to returning to a non-stretched state.

14. The upper-torso garment of claim 9, wherein each first interlocked course of the plurality of first interlocked courses comprises a fifth yarn strand forming a course of interlock tuck stitches that binds a respective front-stitch course to a respective back-stitch course and wherein each second interlocked course of the plurality of second interlocked courses comprises a sixth yarn strand forming a course of interlock tuck stitches that binds a respective front-stitch course to a respective back-stitch course.

15. An upper-torso garment comprising:

a breast-covering portion including a first tubular-jacquard knit zone; and an encapsulation portion including an encapsulation tubular-jacquard knit zone;

the first tubular-jacquard knit zone comprising a first plurality of front-stitch courses and a first plurality of back-stitch courses constructed of a first non-stretch yarn strand and a second non-stretch yarn strand;

wherein each front-stitch course of the first plurality of front-stitch courses intermittently interlocks with a back-stitch course of the first plurality of back-stitch courses to form a plurality of first interlocked courses; and wherein each first interlocked course includes a first set of consecutive stitch locations having a quantity of stitches and includes three interlocking cross overs of the first non-stretch yarn strand and the second non-stretch yarn strand positioned among the first set of consecutive stitch locations, the three interlocking cross overs within the first set of consecutive stitch locations contributing to a first modulus of elasticity of the first tubular-jacquard knit zone; and the encapsulation tubular-jacquard knit zone comprising a second plurality of front-stitch courses and a second plurality of back-stitch courses constructed of a third non-stretch yarn strand and a fourth non-stretch yarn strand;

wherein each front-stitch course of the second plurality of front-stitch courses intermittently interlocks with a back-stitch course of the second plurality of back-stitch courses to form a plurality of second interlocked courses; and wherein each second interlocked course includes a second set of consecutive stitch locations having the quantity of stitches and includes fewer than three interlocking cross overs of the third non-stretch yarn strand and the fourth non-stretch yarn strand positioned among the second set of consecutive stitch locations, the fewer than three interlocking cross overs within the second set of consecutive stitch locations contributing to a second modulus of elasticity of the encapsulation tubular-jacquard knit zone that is greater than the first modulus of elasticity.

16. The upper-torso garment of claim 15, wherein each of the first non-stretch yarn strand, the second non-stretch yarn strand, the third non-stretch yarn strand, and the fourth non-stretch yarn strand includes an amount of elasticity providing a maximum stretch of less than 200% prior to returning to a non-stretched state.

17. The upper-torso garment of claim 15, wherein the first tubular-jacquard knit zone and the encapsulation tubular-jacquard knit zone do not include any yarn strands including an amount of elasticity providing a maximum stretch of more than 200% prior to returning to a non-stretched state.

18. The upper-torso garment of claim 15, wherein the encapsulation tubular-jacquard knit tubular zone of the encapsulation region comprises a first subset of knit tubular structures, a second subset of knit tubular structures, a third subset of knit tubular structures, and a fourth subset of knit tubular structures, wherein each subset of knit tubular structures extends orthogonal to a course direction.

19. The upper-torso garment of claim 18 further comprising a wing portion comprising a wing tubular-jacquard knit zone comprising a third plurality of front-stitch courses and a third plurality of back-stitch courses constructed of a fifth non-stretch yarn strand and a sixth non-stretch yarn strand.

20. The upper-torso garment of claim 19, wherein the first subset of knit tubular structures is positioned between the wing portion and the breast-covering portion.

* * * * *